US005179626A

United States Patent [19]

Thomson

[11] Patent Number: 5,179,626

[45] Date of Patent: Jan. 12, 1993

[54] HARMONIC SPEECH CODING ARRANGEMENT WHERE A SET OF PARAMETERS FOR A CONTINUOUS MAGNITUDE SPECTRUM IS DETERMINED BY A SPEECH ANALYZER AND THE PARAMETERS ARE USED BY A SPEECH SYNTHESIZER TO DETERMINE A SPECTRUM WHICH IS THEN USED TO DETERMINE SINUSOIDS FOR SYNTHESIS

[75] Inventor: David L. Thomson, Lisle, Ill.

[73] Assignee: AT&T Bell Laboratories, Murray Hill, N.J.

[21] Appl. No.: 179,170

[22] Filed: Apr. 8, 1988

[51] Int. Cl.[5] ..... G10L 9/00

[52] U.S. Cl. ..... 395/2

[58] Field of Search ..... 381/29-40, 381/51; 364/513.5

[56] References Cited

U.S. PATENT DOCUMENTS

| | | | |
|---|---|---|---|
| 3,681,530 | 8/1972 | Menley et al. | 381/32 |
| 3,982,070 | 9/1976 | Flannagan | 381/36 |
| 4,184,049 | 1/1980 | Crochiere et al. | 179/1 SA |
| 4,771,465 | 9/1988 | Bronson et al. | 381/36 |
| 4,797,926 | 1/1989 | Bronson et al. | 381/36 |
| 4,815,135 | 3/1989 | Taguchi | 381/37 |

FOREIGN PATENT DOCUMENTS 0259950 3/1988 European Pat. Off. .

OTHER PUBLICATIONS

*1980 Acoustical Society of America,* vol. 68, No. 2, J. L. Flanagan, "Parametric Coding of Speech Spectra", Aug. 1980, pp. 412-431.

*IEEE Transaction on Acoustics, Speech, and Signaling Processing, vol. ASSP-31, No. 3, Jun. 1983, L. B. Almeida, et al., "Nonstationary Spectral Modeling of Voiced Speech", pp. 664-677.*

*1984 IEEE CH1945-5/84/0000-0289,* L. B. Almeida, et al., "Variable-Frequency Synthesis: An Improved Harmonic Coding Scheme", pp. 27.5.1-27.5.4, 1984.

*1984 IEEE CH1945-5/84/0000-0290,* R. J. McAulay, et al., "Magnitude-Only Reconstruction Using a Sinousoidal Speech Model", pp. 27.6.1-27.6.4, 1984.

*1984 IEEE CH2028-9/84/0000-1179,* Y. Shoham, et al., "Pitch Synchronous Transform Coding of Speech at 9.6 Kb/s Based on Vector Quantization", pp. 1179-1182, 1984.

[1985 IEEE CH2118-8/85/0000-0260, I. M. Trancoso, et al., "Pole-Zero Multipulse Speech Representation Using Harmonic Modelling in the Frequency Domain", pp. 260-263, 1985.

*1986 IEEE CH2243-4/86/0000-1233,* J. S. Marques, et al., "A Background for Sinosoid Based Representation of Voiced Speech", pp. 1233-1236, 1986.

*1986 IEEE CH2243-4/86/0000-1713,* R. J. McAulay, et al., "Phase Modelling and Its Application to Sinusoidal Transform Coding", pp. 1713-1715, 1986.

*1986 IEEE CH2243-4/86/0000-1709,* I. M. Trancoso, et al., "A Study on the Relationships Between Stochastic and Harmonic Coding", pp. 1709-1712, 1986.

(List continued on next page.)

*Primary Examiner*—Michael R. Fleming
*Assistant Examiner*—Michelle Doerrler
*Attorney, Agent, or Firm*—R. T. Watland; M. B. Johannesen

[57] ABSTRACT

A harmonic coding arrangement where the magnitude spectrum of the input speech is modeled at the analyzer by a relatively small set of parameters and, significantly, as a continuous rather than only a line magnitude spectrum. The synthesizer, rather than the analyzer, determines the magnitude, frequency, and phase of a large number of sinusoids which are summed to generate synthetic speech. Rather than receiving information explicitly defining the sinusoids from the analyzer, the synthesizer receives the small set of parameters and uses those parameters to determine a spectrum, which, in turn, is used by the synthesizer to determine the sinusoids for synthesis.

38 Claims, 13 Drawing Sheets

Microfiche Appendix Included
(34 Microfiche, 1 Pages)

OTHER PUBLICATIONS

*1986 IEEE 0096-3518/86/0800-0744,* R. J. McAulay, et al., "Speech Analysis/Synthesis Based on a Sinusoidal Representation", pp. 744-754, 1986.

*1987 IEEE CH2396-0/87/0000-1645,* R. J. McAulay, et al., "Multirate Sinusoidal Transform Coding at Rates from 2.4 kbps to 8 kbps", pp. 1645-1648, 1987.

*1987 IEEE CH2396-0/87/0000-2213,* E. C. Bronson, et al., "Harmonic Coding of Speech at 4.8 kb/s", pp. 2213-2216, 1987.

*Onzieme Colloque Gretsi-Nice Du 1er Au 5 Jun. 1987,* J. S. Marques, et al., "Quasi-Optimal Analysis for Sinusoidal Representation of Speech", 1987, pp. 1-4.

*1987 IEEE 0090-6778/87/1000-1059, P-C Chang, et al., "Fourier Transform Vector Quantization for Speech Coding", pp. 1059-1068, 1987.*

*1987 IEEE CH2396-0/87/0000-1641,* E. B. George, et al., "A New Speech Coding Model Based on a Least-Squares Sinusoidal Representation", pp. 1641-1644, 1987.

G. J. Bosscha et al., "DFT-Vocoder using Harmonic-Sieve Pitch Extraction", ICASSP 82—*IEEE International Conference on Acoustics, Speech, and Signal Processing, Paris, May 3-5, 1982, vol. 3, pp. 1952-1955.*

D. W. Griffin et al., "A High Quality 9.6 Kbps Speech Coding System", ICASSP—*IEEE-IECEJ-ASJ International Conference on Acoustics, Speech and Signal Processing,* Tokyo, Apr. 7-11, 1986, vol. 1, pp. 125-128.

J. S. Rodrigues et al., "Harmonic Coding at 8 Kbits/-Sec", ICASSP—*IEEE International Conference on Acoustics, Speech, and Signal Processing, Dallas, Apr. 6-9, 1987, vol. 3, pp. 1621-1624.*

J. S. Marques et al., "A Background for Sinusoid Based Representation of Voiced Speech", *ICASSP-IEEE-IECEJ-ASJ International Conference on Acoustics, Speech, and Signal Processing,* Tokyo, Apr. 7-11, 1986, vol. 2, pp. 1233-1236.

SPEECH ANALYSIS PROGRAM

SPEECH SYNTHESIS PROGRAM

SPEECH ANALYSIS PROGRAM

SPEECH SYNTHESIS PROGRAM

HARMONIC SPEECH CODING ARRANGEMENT WHERE A SET OF PARAMETERS FOR A CONTINUOUS MAGNITUDE SPECTRUM IS DETERMINED BY A SPEECH ANALYZER AND THE PARAMETERS ARE USED BY A SPEECH SYNTHESIZER TO DETERMINE A SPECTRUM WHICH IS THEN USED TO DETERMINE SINUSOIDS FOR SYNTHESIS

MICROFICHE APPENDIX

Included in this application is a Microfiche Appendix. The total number of microfiche is one sheet and the total number of frames is 34.

CROSS-REFERENCE TO RELATED APPLICATION

This application is related to the application D. L. Thomson Case 7, "Vector Quantization in a Harmonic Speech Coding Arrangement", filed concurrently herewith and assigned to the assignee of the present invention.

TECHNICAL FIELD

This invention relates to speech processing.

BACKGROUND AND PROBLEM

Accurate representations of speech have been demonstrated using harmonic models where a sum of sinusoids is used for synthesis. An analyzer partitions speech into overlapping frames, Hamming windows each frame, constructs a magnitude/phase spectrum, and locates individual sinusoids. The correct magnitude, phase, and frequency of the sinusoids are then transmitted to a synthesizer which generates the synthetic speech. In an unquantized harmonic speech coding system, the resulting speech quality is virtually transparent in that most people cannot distinguish the original from the synthetic. The difficulty in applying this approach at low bit rates lies in the necessity of coding up to 80 harmonics. (The sinusoids are referred to herein as harmonics, although they are not always harmonically related.) Bit rates below 9.6 kilobits/second are typically achieved by incorporating pitch and voicing or by dropping some or all of the phase information. The result is synthetic speech differing in quality and robustness from the unquantized version.

One approach typical of the prior art is disclosed in R. J. McAulay and T. F. Quatieri, "Multirate sinusoidal transform coding at rates from 2.4 kbps to 8 kbps," *Proc. IEEE Int. Conf. Acoust., Speech, and Signal Proc.*, vol. 3, pp. 1645–1648, April 1987. A pitch detector is used to determine a fundamental pitch and the speech spectrum is modeled as a line spectrum at the determined pitch and multiples thereof. The value of the determined pitch is transmitted from the analyzer to the synthesizer which reconstructs the speech as a sum of sinusoids at the fundamental frequency and its multiples. The achievable speech quality is limited in such an arrangement, however, since substantial energy of the input speech is typically present between the lines of the line spectrum and because a separate approach is required for unvoiced speech.

In view of the foregoing, a recognized problem in the art is the reduced speech quality achievable in known harmonic speech coding arrangements where the spectrum of the input speech is modeled as only a line spectrum—for example, at only a small number of frequencies or at a fundamental frequency and its multiples.

SOLUTION

The foregoing problem is solved and a technical advance is achieved in accordance with the principles of the invention in a harmonic speech coding arrangement where the magnitude spectrum of the input speech is modeled at the analyzer by a relatively small set of parameters and, significantly, as a continuous rather than only a line magnitude spectrum. The synthesizer, rather than the analyzer, determines the magnitude, frequency, and phase of a large number of sinusoids which are summed to generate synthetic speech of improved quality. Rather than receiving information explicitly defining the sinusoids from the analyzer, the synthesizer receives the small set of parameters and uses those parameters to determine a spectrum, which in turn, is used by the synthesizer to determine the sinusoids for synthesis.

At an analyzer of a harmonic speech coding arrangement, speech is processed in accordance with a method of the invention by first determining a magnitude spectrum from the speech. A set of parameters is then calculated modeling the determined magnitude spectrum as a continuous magnitude spectrum and the parameter set is communicated for use in speech synthesis.

At a synthesizer of a harmonic speech coding arrangement, speech is synthesized in accordance with a method of the invention by receiving a set of parameters and determining a spectrum from the parameter set. The spectrum is then used to determine a plurality of sinusoids, where the sinusoidal frequency of at least one sinusoid is determined based on amplitude values of the spectrum. Speech is then synthesized as a sum of the sinusoids.

At the analyzer of an illustrative harmonic speech coding arrangement described herein, the magnitude spectrum is modeled as a sum of four functions comprising the estimated magnitude spectrum of a previous frame of speech, a magnitude spectrum of a first periodic pulse train, a magnitude spectrum of a second periodic pulse train, and a vector chosen from a codebook. The parameter set is calculated to model the magnitude spectrum in accordance with a minimum mean squared error criterion. A phase spectrum is also determined from the speech and used to calculate a second set of parameters modeling the phase spectrum as a sum of two functions comprising a phase estimate and a vector chosen from a codebook. The phase estimate is determined by performing an all pole analysis, a pole-zero analysis and a phase prediction from a previous frame of speech, and selecting the best estimate in accordance with an error criterion. The analyzer determines a plurality of sinusoids from the magnitude spectrum for use in the phase estimation, and matches the sinusoids of a present frame with those of previous and subsequent frames using a matching criterion that takes into account both the amplitude and frequency of the sinusoids as well as a ratio of pitches of the frames.

At the synthesizer of the illustrative harmonic speech coding arrangement, an estimated magnitude spectrum and an estimated phase spectrum are determined based on the received parameters. A plurality of sinusoids is determined from the estimated magnitude spectrum by finding a peak in that spectrum, subtracting a spectral component associated with the peak, and repeating the process until the estimated magnitude spectrum is below a threshold for all frequencies. The spectral component comprises a wide magnitude spectrum window defined herein. The sinusoids of the present frame are matched with those of previous and subsequent frames using the same matching criterion used at the analyzer. The sinusoids are then constructed having their sinusoidal amplitude and frequency determined from the estimated magnitude spectrum and their sinusoidal phase determined from the estimated phase spectrum. Speech is synthesized by summing the sinusoids, where interpolation is performed between matched sinusoids, and unmatched sinusoids remain at a constant frequency.

DRAWING DESCRIPTION

GENERAL DESCRIPTION

Figure 1:
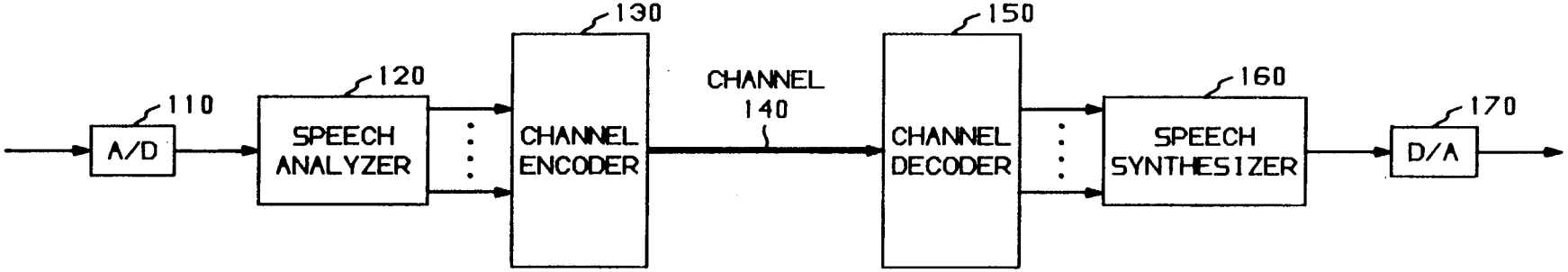
FIG. 1 is a block diagram of an exemplary harmonic speech coding arrangement in accordance with the invention.

The approach of the present harmonic speech coding arrangement is to transmit the entire complex spectrum instead of sending individual harmonics. One advantage of this method is that the frequency of each harmonic need not be transmitted since the synthesizer, not the analyzer, estimates the frequencies of the sinusoids that are summed to generate synthetic speech. Harmonics are found directly from the magnitude spectrum and are not required to be harmonically related to a fundamental pitch.

To transmit the continuous speech spectrum at a low bit rate, it is necessary to characterize the spectrum with a set of continuous functions that can be described by a small number of parameters. Functions are found to match the magnitude/phase spectrum computed from a fast Fourier transform (FFT) of the input speech. This is easier than fitting the real/imaginary spectrum because special redundancy characteristics may be exploited. For example, magnitude and phase may be partially predicted from the previous frame since the magnitude spectrum remains relatively constant from frame to frame, and phase increases at a rate proportional to frequency.

Another useful function for representing magnitude and phase is a pole-zero model. The voice is modeled as the response of a pole-zero filter to ideal impulses. The magnitude and phase are then derived from the filter parameters. Error remaining in the model estimate is vector quantized. Once the spectra are matched with a set of functions, the model parameters are transmitted to the synthesizer where the spectra are reconstructed. Unlike pitch and voicing based strategies, performance is relatively insensitive to parameter estimation errors.

In the illustrative embodiment described herein, speech is coded using the following procedure:

ANALYSIS

1. Model the complex spectral envelope with poles and zeros.
2. Find the magnitude spectral envelope from the complex envelope.
3. Model fine pitch structure in the magnitude spectrum.
4. Vector quantize the remaining error.
5. Evaluate two methods of modeling the phase spectrum:
   a. Derive phase from the pole-zero model.
   b. Predict phase from the previous frame.
6. Choose the best method in step 5 and vector quantize the residual error.
7. Transmit the model parameters.

SYNTHESIS

1. Reconstruct the magnitude and phase spectra.
2. Determine the sinusoidal frequencies from the magnitude spectrum.
3. Generate speech as a sum of sinusoids.

MODELING THE MAGNITUDE SPECTRUM

To represent the spectral magnitude with as few parameters as possible, advantage is taken of redundancy in the spectrum. The magnitude spectrum consists of an envelope defining the general shape of the spectrum and approximately periodic components that give it a fine structure. The smooth magnitude spectral envelope is represented by the magnitude response of an all-pole or pole-zero model. Pitch detectors are capable of representing the fine structure when periodicity is clearly present but often lack robustness under nonideal conditions. In fact, it is difficult to find a single parametric function that closely fits the magnitude spectrum for a wide variety of speech characteristics. A reliable estimate may be constructed from a weighted sum of several functions. Four functions that were found to work particularly well are the estimated magnitude spectrum of the previous frame, the magnitude spectrum of two periodic pulse trains and a vector chosen from a codebook. The pulse trains and the codeword are Hamming windowed in the time domain and weighted in the frequency domain by the magnitude envelope to preserve the overall shape of the spectrum. The optimum weights are found by well-known mean squared error (MSE) minimization techniques. The best frequency for each pulse train and the optimum code vector are not chosen simultaneously. Rather, one frequency at a time is found and then the codeword is chosen. If there are m functions $d_i(\omega)$, $1 \leqq i \leqq m$, and corresponding weights $\alpha_{i,m}$, then the estimate of the magnitude spectrum $|F(\omega)|$ is $$|\hat{F}(\omega)| = \sum_{i=1}^{m} \alpha_{i,m} d_i(\omega). \tag{1}$$

Note that the magnitude spectrum is modeled as a continuous spectrum rather than a line spectrum. The optimum weights are chosen to minimize $$\int_0^{\omega_S/2} \left[ |F(\omega)| - \sum_{i=1}^{m} \alpha_{i,m} d_i(\omega) \right]^2 d\omega. \quad (2)$$

where $F(\omega)$ is the speech spectrum, $\omega_s$ is the sampling frequency, and m is the number of functions included.

The frequency of the first pulse train is found by testing a range (40–400 Hz) of possible frequencies and selecting the one that minimizes (2) for $m=2$. For each candidate frequency, optimal values of $\alpha_{i,m}$, are computed. The process is repeated with $m=3$ to find the second frequency. When the magnitude spectrum has no periodic structure as in unvoiced speech, one of the pulse trains often has a low frequency so that windowing effects cause the associated spectrum to be relatively smooth.

The code vector is the entry in a codebook that minimizes (2) for $m=4$ and is found by searching. In the illustrative embodiment described herein, codewords were constructed from the FFT of 16 sinusoids with random frequencies and amplitudes.

PHASE MODELING

Proper representation of phase in a sinusoidal speech synthesizer is important in achieving good speech quality. Unlike the magnitude spectrum, the phase spectrum need only be matched at the harmonics. Therefore, harmonics are determined at the analyzer as well as the synthesizer. Two methods of phase estimation are used in the present embodiment. Both are evaluated for each speech frame and the one yielding the least error is used. The first is a parametric method that derives phase from the spectral envelope and the location of a pitch pulse. The second assumes that phase is continuous and predicts phase from that of the previous frame.

Homomorphic phase models have been proposed where phase is derived from the magnitude spectrum under assumptions of minimum phase. A vocal tract phase function $\phi_k$ may also be derived directly from an all-pole model. The actual phase $\theta_k$ of a harmonic with frequency $\omega_k$ is related to $\phi_k$ by $$\theta_k = \phi_k - t_0\omega_k + 2\pi\lambda + \epsilon_k, \quad (3)$$

where $t_0$ is the location in time of the onset of a pitch pulse, $\lambda$ is an integer, and $\epsilon_k$ is the estimation error or phase residual.

The variance of $\epsilon_k$ may be substantially reduced by replacing the all-pole model with a pole-zero model. Zeros aid representation of nasals and speech where the shape of the glottal pulse deviates from an ideal impulse. In accordance with a method that minimizes the complex spectral error, a filter $H(\omega_k)$ consisting of p poles and q zeros is specified by coefficients $a_i$ and $b_i$ where $$H(\omega_k) = \frac{\sum_{i=0}^{q} b_i e^{-j\omega ki}}{\sum_{i=0}^{p} a_i e^{-j\omega ki}}. \quad (4)$$

The optimum filter minimizes the total squared spectral error $$E_S = \sum_{k=1}^{K} |e^{-j\omega_k t_0} H(\omega_k) - F(\omega_k)|^2. \quad (5)$$

Since $H(\omega_k)$ models only the spectral envelope, $\omega_k$, $1 \leqq k \leqq K$, corresponds to peaks in the magnitude spectrum. No closed form solution for this expression is known so an iterative approach is used. The impulse is located by trying a range of values of $t_0$ and selecting the value that minimizes $E_s$. Note that $H(\omega_k)$ is not constrained to be minimum phase. There are cases where the pole-zero filter yields an accurate phase spectrum, but gives errors in the magnitude spectrum. The simplest solution in these cases is to revert to an all-pole filter.

The second method of estimating phase assumes that frequency changes linearly from frame to frame and that phase is continuous. When these conditions are met, phase may be predicted from the previous frame. The estimated increase in phase of a harmonic is $t\bar{\omega}_k$ where $\omega_k$ is the average frequency of the harmonic and t is the time between frames. This method works well when good estimates for the previous frame are available and harmonics are accurately matched between frames.

After phase has been estimated by the method yielding the least error, a phase residual $\epsilon_k$ remains. The phase residual may be coded by replacing $\epsilon_k$ with a random vector $\Psi_{c,k}$, $1 \leqq c \leqq C$, selected from a codebook of C codewords. Codeword selection consists of an exhaustive search to find the codeword yielding the least mean squared error (MSE). The MSE between two sinusoids of identical frequency and amplitude $A_k$ but differing in phase by an angle $\nu_k$ is $A_k^2[1-\cos(\nu_k)]$. The codeword is chosen to minimize $$\sum_{k=1}^{K} A_k^2[1 - \cos(\epsilon_k - \psi_{c,k})] \quad (6)$$

This criterion also determines whether the parametric or phase prediction estimate is used.

Since phase residuals in a given spectrum tend to be uncorrelated and normally distributed, the codewords are constructed from white Gaussian noise sequences. Code vectors are scaled to minimize the error although the scaling factor is not always optimal due to nonlinearities.

HARMONIC MATCHING

Correctly matching harmonics from one frame to another is particularly important for phase prediction. Matching is complicated by fundamental pitch variation between frames and false low-level harmonics caused by sidelobes and window subtraction. True harmonics may be distinguished from false harmonics by incorporating an energy criterion. Denote the amplitude of the $k^{th}$ harmonic in frame m by $A_k^{(m)}$. If the energy normalized amplitude ratio $$\left[ [A_k^{(m)}]^2 / \sum_{i=1}^{K} [A_i^{(m)}]^2 \right] / \left[ [A_l^{(m-1)}]^2 / \sum_{i=1}^{K} [A_i^{(m-1)}]^2 \right] \quad (7)$$

or its inverse is greater than a fixed threshold, then $A_k^{(m)}$ and $A_l^{(m-1)}$ likely do not correspond to the same harmonic and are not matched. The optimum threshold is experimentally determined to be about four, but the exact value is not critical.

Pitch changes may be taken into account by estimating the ratio $\gamma$ of the pitch in each frame to that of the previous frame. A harmonic with frequency $\omega_k^{(m)}$ is considered to be close to a harmonic of frequency $\omega_k^{(m-1)}$ if the adjusted difference frequency $$|\omega_k^{(m)} - \gamma\omega_l^{(m-1)}| \tag{8}$$

is small. Harmonics in adjacent frames that are closest according to (8) and have similar amplitudes according to (7) are matched. If the correct matching were known, $\gamma$ could be estimated from the average ratio of the pitch of each harmonic to that of the previous frame weighted by its amplitude $$\hat{\gamma} = \sum_{k=1}^{K} \frac{[A_k^{(m)}]^2}{\sum_{i=1}^{K} [A_i^{(m)}]^2} \cdot \frac{\omega_k^{(m)}}{\omega_k^{(m-1)}}. \tag{9}$$

The value of $\gamma$ is unknown but may be approximated by initially letting $\gamma$ equal one and iteratively matching harmonics and updating $\gamma$ until a stable value is found. This procedure is reliable during rapidly changing pitch and in the presence of false harmonics.

SYNTHESIS

A unique feature of the parametric model is that the frequency of each sinusoid is determined from the magnitude spectrum by the synthesizer and need not be transmitted. Since windowing the speech causes spectral spreading of harmonics, frequencies are estimated by locating peaks in the spectrum. Simple peak-picking algorithms work well for most voiced speech, but result in an unnatural tonal quality for unvoiced speech. These impairments occur because, during unvoiced speech, the number of peaks in a spectral region is related to the smoothness of the spectrum rather than the spectral energy.

The concentration of peaks can be made to correspond to the area under a spectral region by subtracting the contribution of each harmonic as it is found. First, the largest peak is assumed to be a harmonic. The magnitude spectrum of the scaled, frequency shifted Hamming window is then subtracted from the magnitude spectrum of the speech. The process repeats until the magnitude spectrum is reduced below a threshold at all frequencies.

When frequency estimation error due to FFT resolution causes a peak to be estimated to one side of its true location, portions of the spectrum remain on the other side after window subtraction, resulting in a spurious harmonic. Such artifacts of frequency errors within the resolution of the FFT may be eliminated by using a modified window transform $W'_i = \max(W_{i-1}, W_i, W_{i+1})$, where $W_i$ is a sequence representing the FFT of the time window. $W'_i$ is referred to herein as a wide magnitude spectrum window. For large FFT sizes, $W'_i$ approaches $W_i$.

To prevent discontinuities at frame boundaries in the present embodiment, each frame is windowed with a raised cosine function overlapping halfway into the next and previous frames. Harmonic pairs in adjacent frames that are matched to each other are linearly interpolated in frequency so that the sum of the pair is a continuous sinusoid. Unmatched harmonics remain at a constant frequency.

DETAILED DESCRIPTION

An illustrative speech processing arrangement in accordance with the invention is shown in block diagram form in FIG. 1. Incoming analog speech signals are converted to digitized speech samples by an A/D converter 110. The digitized speech samples from converter 110 are then processed by speech analyzer 120. The results obtained by analyzer 120 are a number of parameters which are transmitted to a channel encoder 130 for encoding and transmission over a channel 140. A channel decoder 150 receives the quantized parameters from channel 140, decodes them, and transmits the decoded parameters to a speech synthesizer 160. Synthesizer 160 processes the parameters to generate digital, synthetic speech samples which are in turn processed by a D/A converter 170 to reproduce the incoming analog speech signals.

A number of equations and expressions (10) through (26) are presented in Tables 1, 2 and 3 for convenient reference in the following description.

TABLE 1

$$nrg = \frac{8L}{3W} \sum_{i=0}^{W-1} S_i^2 \tag{10}$$

$$H(\omega_k) = \frac{1}{\sum_{i=0}^{p} a_i e^{-j\omega k i}} \tag{11}$$

$$\sum_{k=1}^{K} [|H(\omega_k)| - |F(\omega_k)|]^2 \tag{12}$$

$$\text{alpha1} = \text{oldalpha1} + \frac{0.9*8i^3}{(SR1)^3} \tag{13}$$

$$f1 = 40e^{alpha1*ln(10)} \tag{14}$$

$$E_1 = \sum_{k=0}^{256} \left[ |F(k)| - \sum_{i=1}^{2} \alpha_{i,2} d_i(k) \right]^2 \tag{15}$$

$$\text{alpha2} = \text{oldapha2} + \frac{0.9*8i^3}{(SR2)^3} \tag{16}$$

TABLE 2

$$f2 = 40e^{alpha2*ln(10)} \tag{17}$$

$$E_2 = \sum_{k=0}^{256} \left[ |F(k)| - \sum_{i=1}^{3} \alpha_{i,3} d_i(k) \right]^2 \tag{18}$$

$$E_3 = \sum_{k=0}^{256} \left[ |F(k)| - \sum_{i=1}^{4} \alpha_{i,4} d_i(k) \right]^2 \tag{19}$$

$$|\hat{F}(\omega)| = \sum_{i=1}^{4} \alpha_{i,4} d_i(\omega) \tag{20}$$

$$\rho = \sum_{k=1}^{K} \frac{[A_k^{(m)}]^2}{\sum_{i=1}^{K} [A_i^{(m)}]^2} \cdot \frac{\omega_k^{(m)}}{\omega_k^{(m-1)}} \tag{21}$$

$$\theta(\omega_k) = arg[e^{-j\omega(k)t0} H(\omega_k)] \tag{22}$$

$$E_p = \sum_{k=1}^{K} A_k^2 [1 - \cos(\theta(\omega_k) - \theta(\omega_k))] \tag{23}$$

TABLE 3

$$\sum_{k=1}^{K} A_k^2 [1 - \cos(\theta(\omega_k) - \theta(\omega_k) - \gamma_c \psi_{c,k})] \tag{24}$$

$$\hat{\theta}(\omega_k) = arg[e^{-j\omega_k t0} H(\omega_k)] + \gamma_c \psi_{c,k} \tag{25}$$

TABLE 3-continued $$\theta_m(\omega_k) = \frac{\omega_k^{(m)} + \omega_l^{(m-1)}}{2} t + \gamma_c \psi_{c,k} \quad (26)$$

Figure 2:
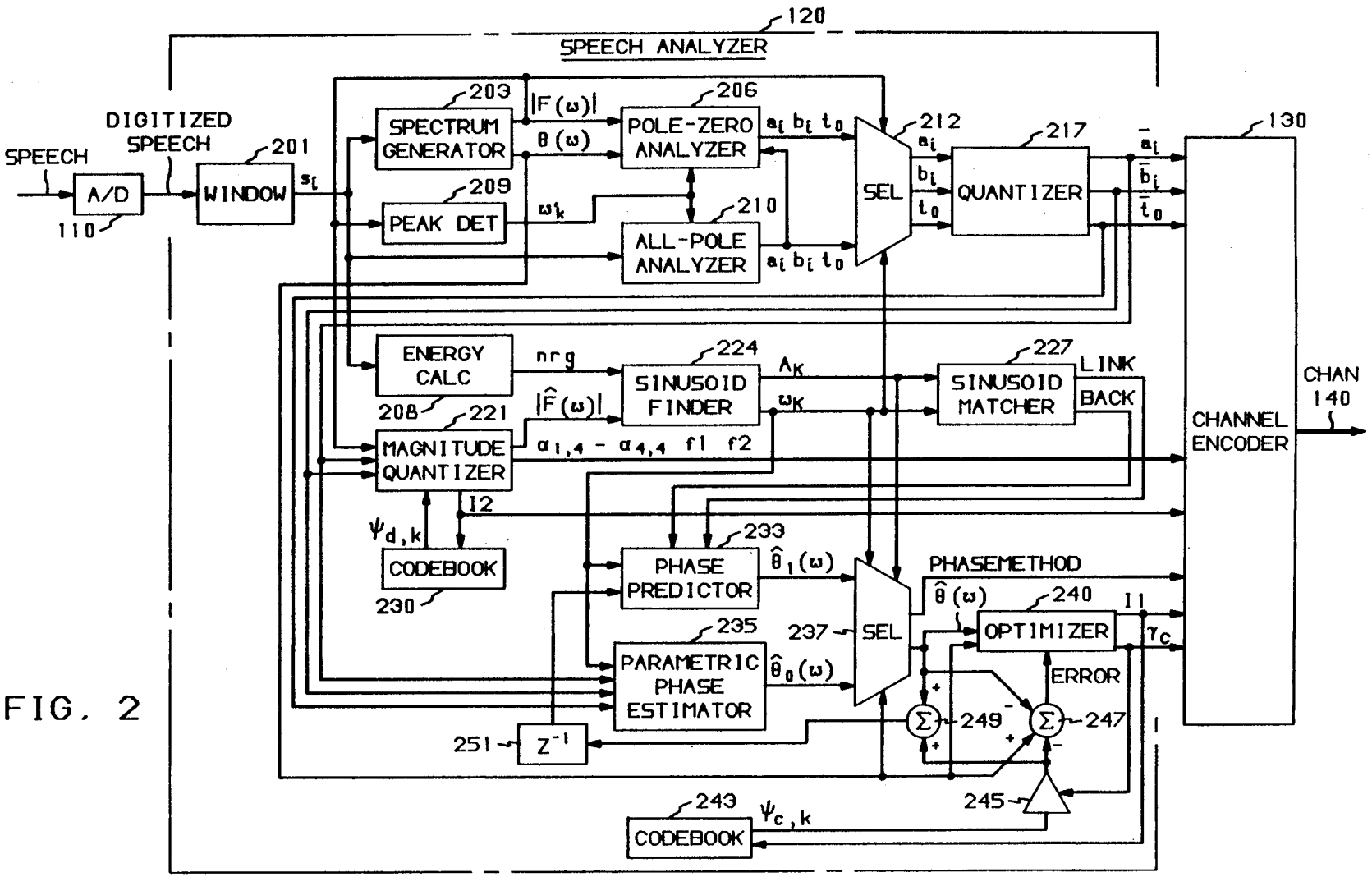
FIG. 2 is a block diagram of a speech analyzer included in the arrangement of FIG. 1.

Speech analyzer 120 is shown in greater detail in FIG. 2. Converter 110 groups the digital speech samples into overlapping frames for transmission to a window unit 201 which Hamming windows each frame to generate a sequence of speech samples, $s_i$. The framing and windowing techniques are well known in the art. A spectrum generator 203 performs an FFT of the speech samples, $s_i$, to determine a magnitude spectrum, $|F(\omega)|$, and a phase spectrum, $\theta(\omega)$. The FFT performed by spectrum generator 203 comprises a one-dimensional Fourier transform. The determined magnitude spectrum $|F(\omega)|$ is an interpolated spectrum in that it comprises a greater number of frequency samples than the number of speech samples, $s_i$, in a frame of speech. The interpolated spectrum may be obtained either by zero padding the speech samples in the time domain or by interpolating between adjacent frequency samples of a noninterpolated spectrum. An all-pole analyzer 210 processes the windowed speech samples, $s_i$, using standard linear predictive coding (LPC) techniques to obtain the parameters, $a_i$, for the all-pole model given by equation (11), and performs a sequential evaluation of equations (22) and (23) to obtain a value of the pitch pulse location, $t_0$, that minimizes $E_p$. The parameter, p, in equation (11) is the number of poles of the all-pole model. The frequencies $\omega_k$ used in equations (22), (23) and (11) are the frequencies $\omega'_k$ determined by a peak detector 209 by simply locating the peaks of the magnitude spectrum $|F(\omega)|$. Analyzer 210 transmits the values of $a_i$ and $t_0$ obtained together with zero values for the parameters, $b_i$, (corresponding to zeros of a pole-zero analysis) to a selector 212. A pole-zero analyzer 206 first determines the complex spectrum, $F(\omega)$, from the magnitude spectrum, $|F(\omega)|$, and the phase spectrum, $\theta(\omega)$. Analyzer 206 then uses linear methods and the complex spectrum, $F(\omega)$, to determine values of the parameters $a_i$, $b_i$, and $t_0$ to minimize $E_s$ given by equation (5) where $H(\omega_k)$ is given by equation (4). The parameters, p and z, in equation (4) are the number of poles and zeroes, respectively, of the pole-zero model. The frequencies $\omega_k$ used in equations (4) and (5) are the frequencies $\omega'_k$ determined by peak detector 209. Analyzer 206 transmits the values of $a_i$, $b_i$, and $t_0$ to selector 212. Selector 212 evaluates the all-pole analysis and the pole-zero analysis and selects the one that minimizes the mean squared error given by equation (12). A quantizer 217 uses a well-known quantization method on the parameters selected by selector 212 to obtain values of quantized parameters, $\bar{a}_i$, $\bar{b}_i$, and $\bar{t}_0$, for encoding by channel encoder 130 and transmission over channel 140.

A magnitude quantizer 221 uses the quantized parameters $\bar{a}_i$ and $\bar{b}_i$, the magnitude spectrum $|\hat{F}(\omega)|$, and a vector, $\Psi_{d,k}$, selected from a codebook 230 to obtain an estimated magnitude spectrum, $|\hat{F}(\omega)|$, and a number of parameters $\alpha_{1,4}$, $\alpha_{2,4}$, $\alpha_{3,4}$, $\alpha_{4,4}$, f1, f2. Magnitude quantizer 221 is shown in greater detail in FIG. 4. A summer 421 generates the estimated magnitude spectrum, $|F(\omega)|$, as the weighted sum of the estimated magnitude spectrum of the previous frame obtained by a delay unit 423, the magnitude spectrum of two periodic pulse trains generated by pulse train transform generators 403 and 405, and the vector, $\Psi_{d,k}$, selected from codebook 230. The pulse trains and the vector or codeword are Hamming windowed in the time domain, and are weighted. via spectral multipliers 407, 409, and 411, by a magnitude spectral envelope generated by a generator 401 from the quantized parameters $\bar{a}_i$ and $\bar{b}_i$. The generated functions $d_1(\omega)$, $d_2(\omega)$, $d_3(\omega)$, $d_4(\omega)$ are further weighted by multipliers 413, 415, 417, and 419 respectively, where the weights $\alpha_{1,4}$, $\alpha_{2,4}$, $\alpha_{3,4}$, $\alpha_{4,4}$ and the frequencies f1 and f2 of the two periodic pulse trains are chosen by an optimizer 427 to minimize equation (2).

A sinusoid finder 224 (FIG. 2) determines the amplitude, $A_k$, and frequency, $\omega_k$, of a number of sinusoids by analyzing the estimated magnitude spectrum, $|\hat{F}(\omega)|$. Finder 224 first finds a peak in $|\hat{F}(\omega)|$. Finder 224 then constructs a wide magnitude spectrum window, with the same amplitude and frequency as the peak. The wide magnitude spectrum window is also referred to herein as a modified window transform. Finder 224 then subtracts the spectral component comprising the wide magnitude spectrum window from the estimated magnitude spectrum, $|\hat{F}(\omega)|$. Finder 224 repeats the process with the next peak until the estimated magnitude spectrum, $|\hat{F}(\omega)|$, is below a threshold for all frequencies. Finder 224 then scales the harmonics such that the total energy of the harmonics is the same as the energy, nrg, determined by an energy calculator 208 from the speech samples, $s_i$, as given by equation (10). A sinusoid matcher 227 then generates an array, BACK, defining the association between the sinusoids of the present frame and sinusoids of the previous frame matched in accordance with equations (7), (8), and (9). Matcher 227 also generates an array, LINK, defining the association between the sinusoids of the present frame and sinusoids of the subsequent frame matched in the same manner and using well-known frame storage techniques.

A parametric phase estimator 235 uses the quantized parameters $\bar{a}_i$, $\bar{b}_i$, and $\bar{t}_0$ to obtain an estimated phase spectrum, $\hat{\theta}_0(\omega)$, given by equation (22). A phase predictor 233 obtains an estimated phase spectrum, $\hat{\theta}_1(\omega)$, by prediction from the previous frame assuming the frequencies are linearly interpolated. A selector 237 selects the estimated phase spectrum, $\hat{\theta}(\omega)$, that minimizes the weighted phase error, given by equation (23), where $A_k$ is the amplitude of each of the sinusoids, $\hat{\theta}(\omega_k)$ is the true phase, and $\hat{\theta}(\omega_k)$ is the estimated phase. If the parametric method is selected, a parameter, phasemethod, is set to zero. If the prediction method is selected, the parameter, phasemethod, is set to one. An arrangement comprising summer 247, multiplier 245, and optimizer 240 is used to vector quantize the error remaining after the selected phase estimation method is used. Vector quantization consists of replacing the phase residual comprising the difference between $\hat{\theta}(\omega_k)$ and $\hat{\theta}(\omega_k)$ with a random vector $\Psi_{c,k}$ selected from codebook 243 by an exhaustive search to determine the codeword that minimizes mean squared error given by equation (24). The index, I1, to the selected vector, and a scale factor $\gamma_c$ are thus determined. The resultant phase spectrum is generated by a summer 249. Delay unit 251 delays the resultant phase spectrum by one frame for use by phase predictor 251.

Figure 3:
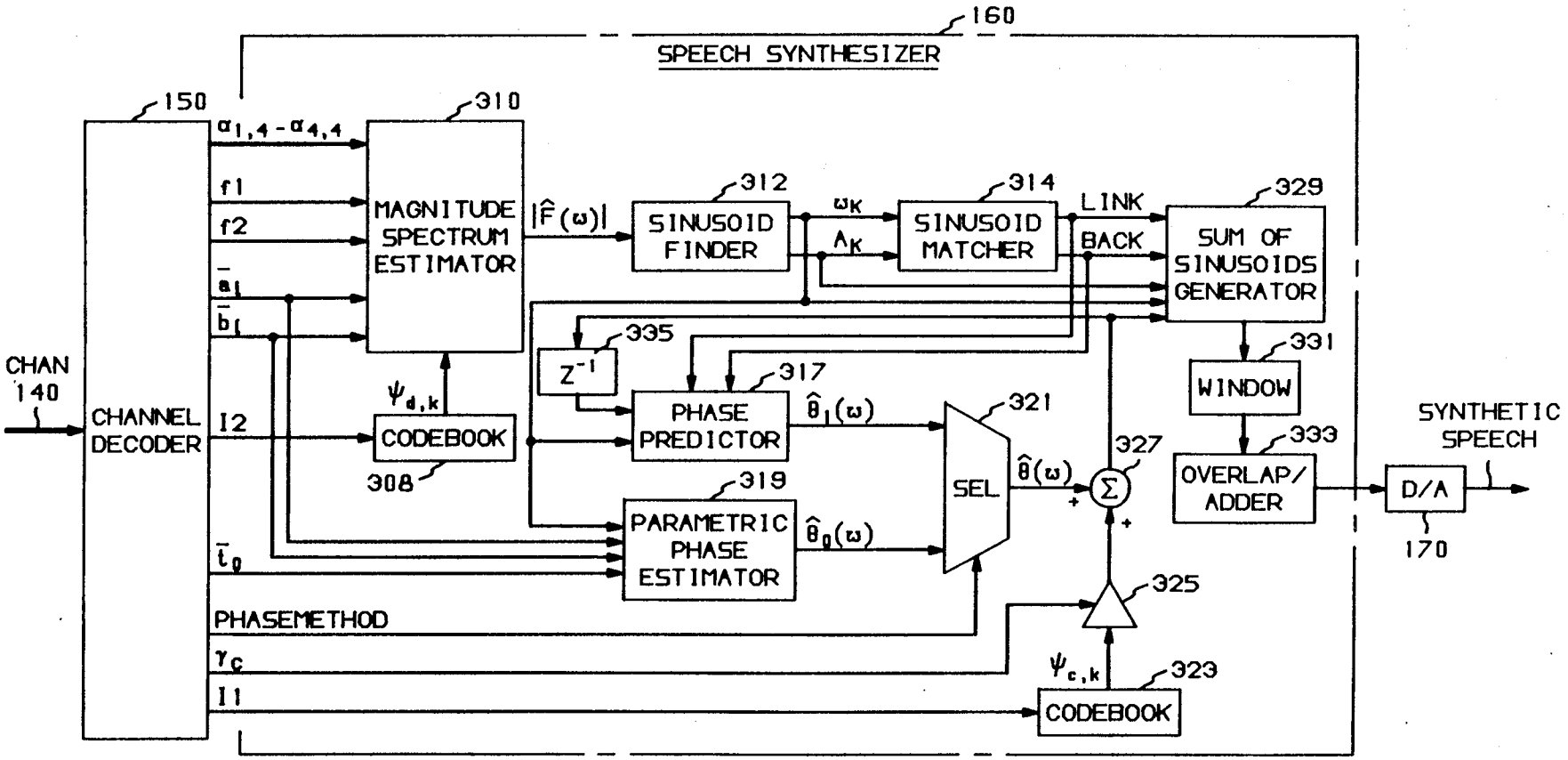
FIG. 3 is a block diagram of a speech synthesizer included in the arrangement of FIG. 1.
Figure 4:
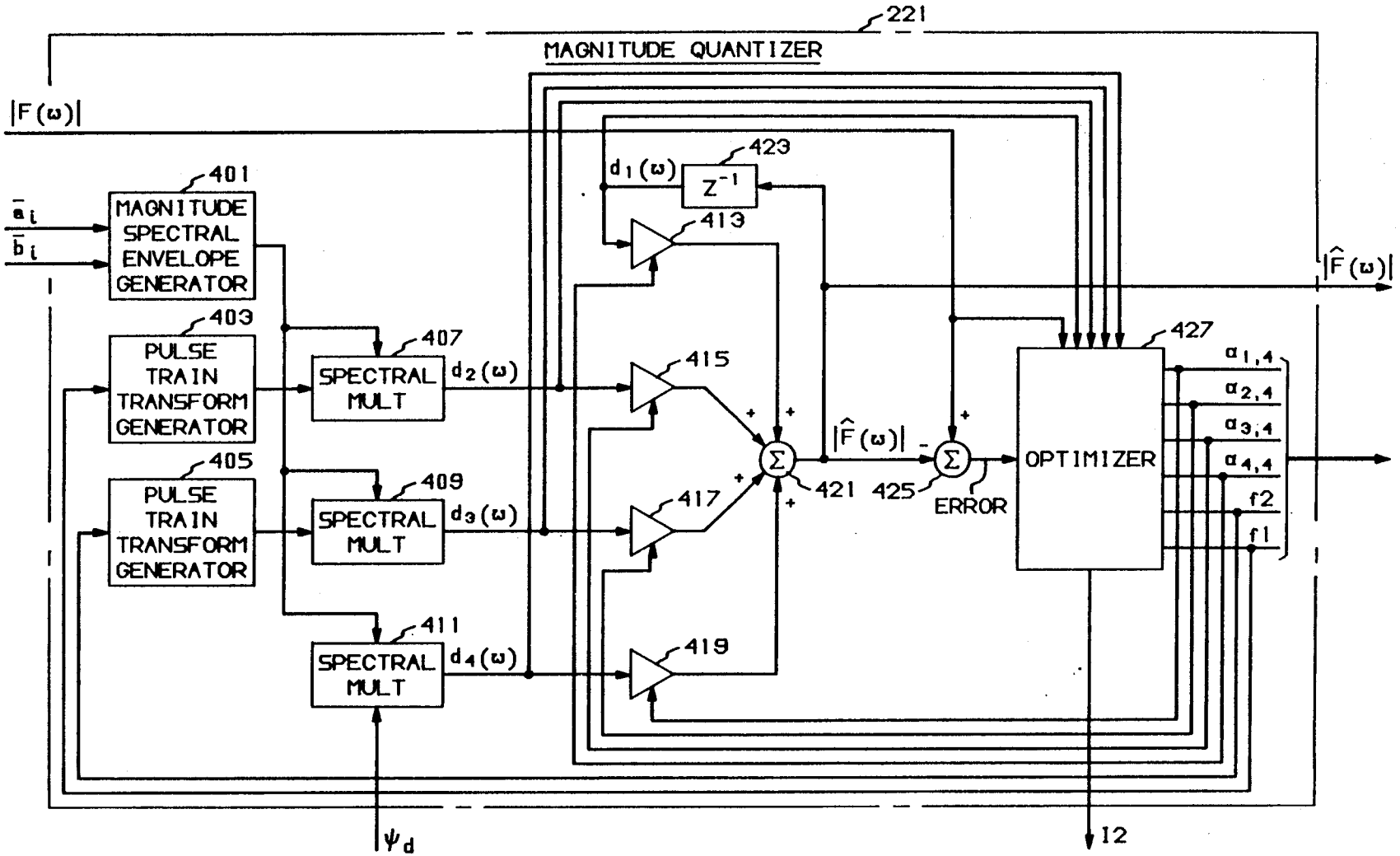
FIG. 4 is a block diagram of a magnitude quantizer included in the analyzer of FIG. 2.
Figure 5:
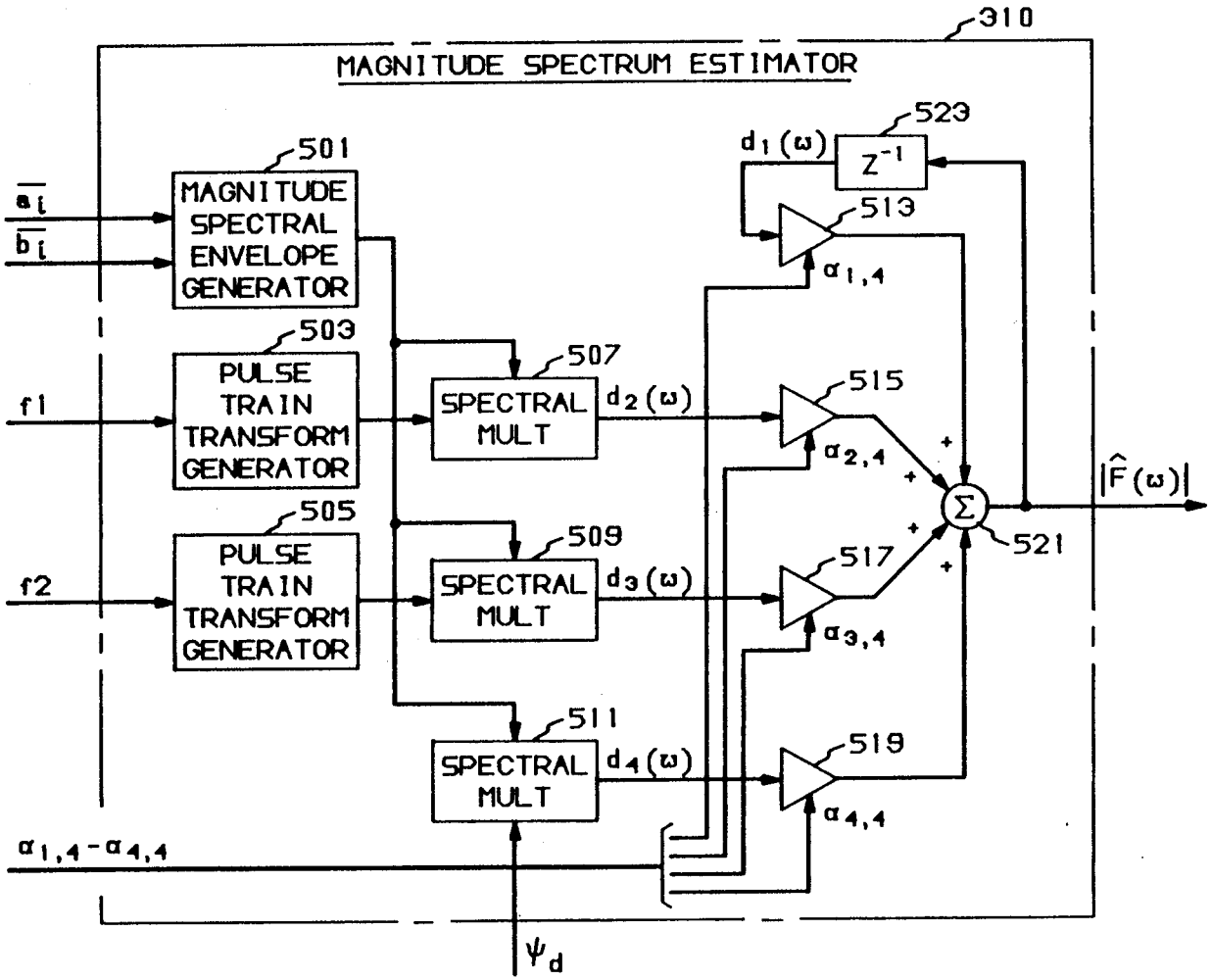
FIG. 5 is a block diagram of a magnitude spectrum estimator included in the synthesizer of FIG. 3.

Speech synthesizer 160 is shown in greater detail in FIG. 3. The received index, I2, is used to determine the vector $\Psi_{d,k}$, from a codebook 308. The vector, $\Psi_{d,k}$, and the received parameters $\alpha_{1,4}$, $\alpha_{2,4}$, $\alpha_{3,4}$, $\alpha_{4,4}$, f1, f2, $\bar{a}_i$, $\bar{b}_i$ are used by a magnitude spectrum estimator 310 to determine the estimated magnitude spectrum $|\hat{F}(\omega)|$ in accordance with equation (1). The elements of estimator 310 (FIG. 5)—501, 503, 505, 507, 509, 511, 513, 515, 517, 519, 521, 523—perform the same function that corresponding elements—401, 403, 405, 407, 409, 411, 413, 415, 417, 419, 421, 423—perform in magnitude quantizer 221 (FIG. 4). A sinusoid finder 312 (FIG. 3) and sinusoid matcher 314 perform the same functions in synthesizer 160 as sinusoid finder 224 (FIG. 2) and sinusoid matcher 227 in analyzer 120 to determine the amplitude, $A_k$, and frequency, $\omega_k$, of a number of sinusoids, and the arrays BACK and LINK, defining the association of sinusoids of the present frame with sinusoids of the previous and subsequent frames respectively. Note that the sinusoids determined in speech synthesizer 160 do not have predetermined frequencies. Rather the sinusoidal frequencies are dependent on the parameters received over channel 140 and are determined based on amplitude values of the estimated magnitude spectrum $|\hat{F}(\omega)|$. The sinusoidal frequencies are nonuniformly spaced.

A parametric phase estimator 319 uses the received parameters $\bar{a}_i$, $\bar{b}_i$, $\bar{t}_0$, together with the frequencies $\omega_k$ of the sinusoids determined by sinusoid finder 312 and either all-pole analysis or pole-zero analysis (performed in the same manner as described above with respect to analyzer 210 (FIG. 2) and analyzer 206) to determine an estimated phase spectrum, $\hat{\theta}_0(\omega)$. If the received parameters, $\bar{b}_i$, are all zero, all-pole analysis is performed. Otherwise, pole-zero analysis is performed. A phase predictor 317 (FIG. 3) obtains an estimated phase spectrum, $\hat{\theta}_1(\omega)$, from the arrays LINK and BACK in the same manner as phase predictor 233 (FIG. 2). The estimated phase spectrum is determined by estimator 319 or predictor 317 for a given frame dependent on the value of the received parameter, phasemethod. If phasemethod is zero, the estimated phase spectrum obtained by estimator 319 is transmitted via a selector 321 to a summer 327. If phasemethod is one, the estimated phase spectrum obtained by predictor 317 is transmitted to summer 327. The selected phase spectrum is combined with the product of the received parameter, $\gamma_c$, and the vector, $\Psi_{c,k}$, of codebook 323 defined by the received index I1, to obtain a resultant phase spectrum as given by either equation (25) or equation (26) depending on the value of phasemethod. The resultant phase spectrum is delayed one frame by a delay unit 335 for use by phase predictor 317. A sum of sinusoids generator 329 constructs K sinusoids of length W (the frame length), frequency $\omega_k$, $1 \leqq k \leqq K$, amplitude $A_k$, and phase $\hat{\theta}_k$. Sinusoid pairs in adjacent frames that are matched to each other are linearly interpolated in frequency so that the sum of the pair is a continuous sinusoid. Unmatched sinusoids remain at constant frequency. Generator 329 adds the constructed sinusoids together, a window unit 331 windows the sum of sinusoids with a raised cosine window, and an overlap/adder 333 overlaps and adds with adjacent frames. The resulting digital samples are then converted by D/A converter 170 to obtain analog, synthetic speech.

Figure 6:
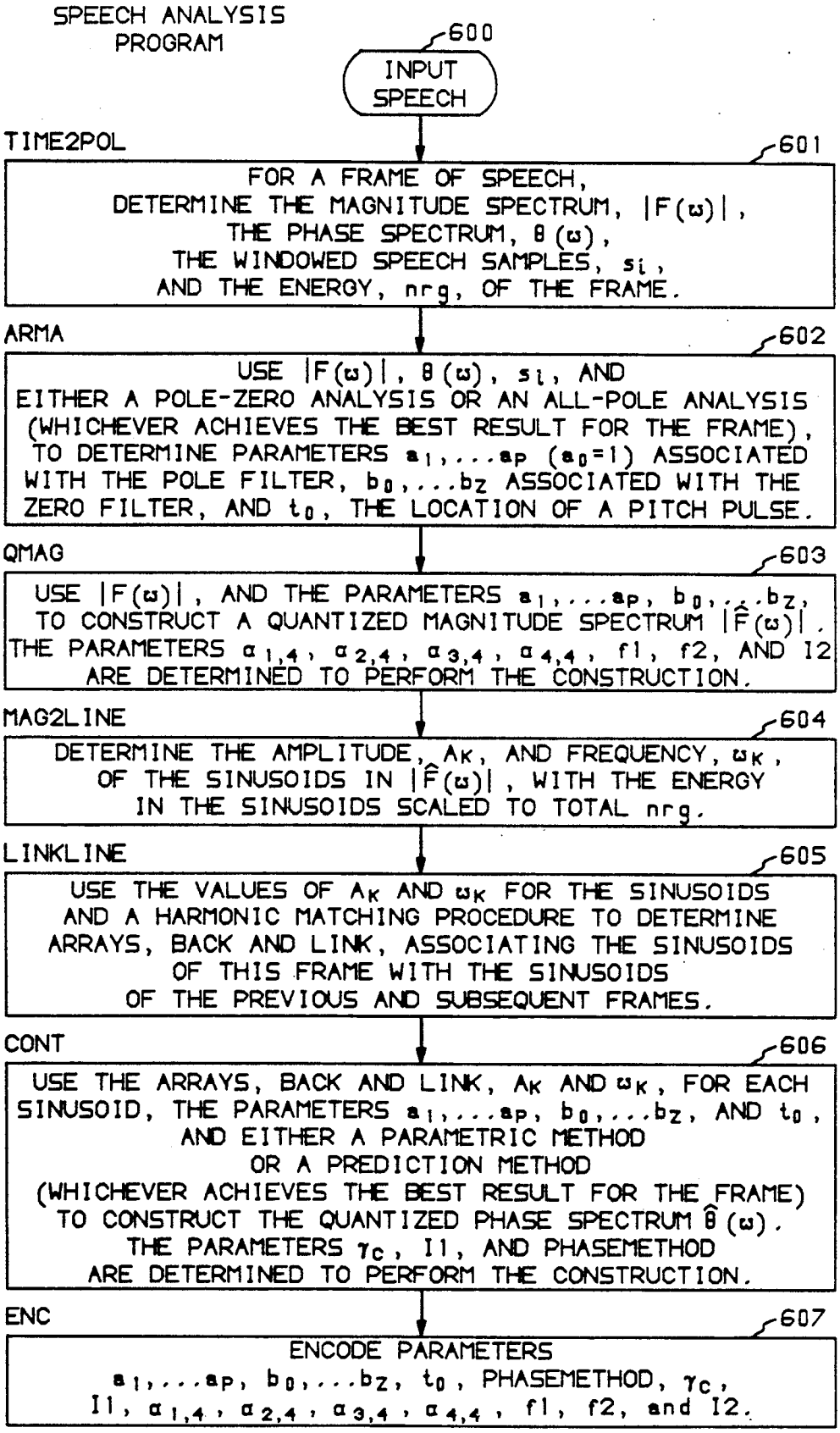
FIGS. 6 and 7 are flow charts of exemplary speech analysis and speech synthesis programs, respectively.
Figure 8:
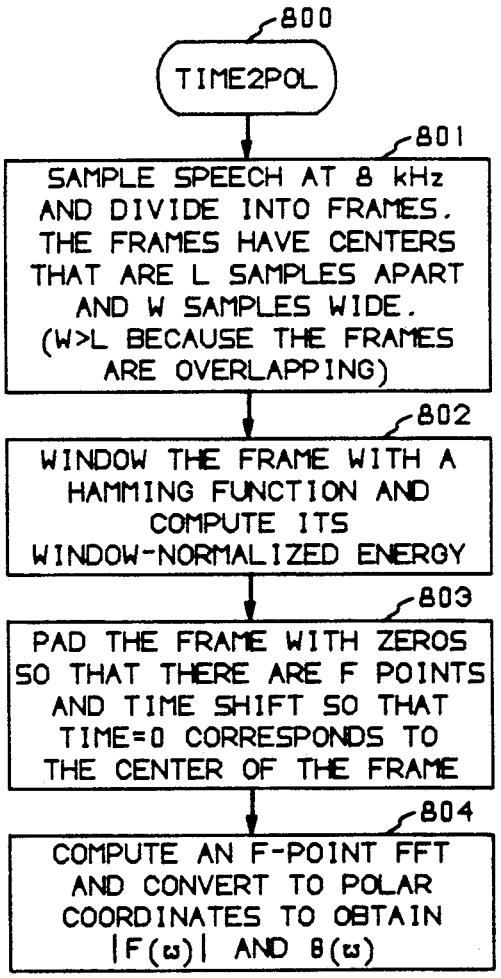
FIGS. 8 through 13 are more detailed flow charts of routines included in the speech analysis program of FIG. 6.
Figure 9:
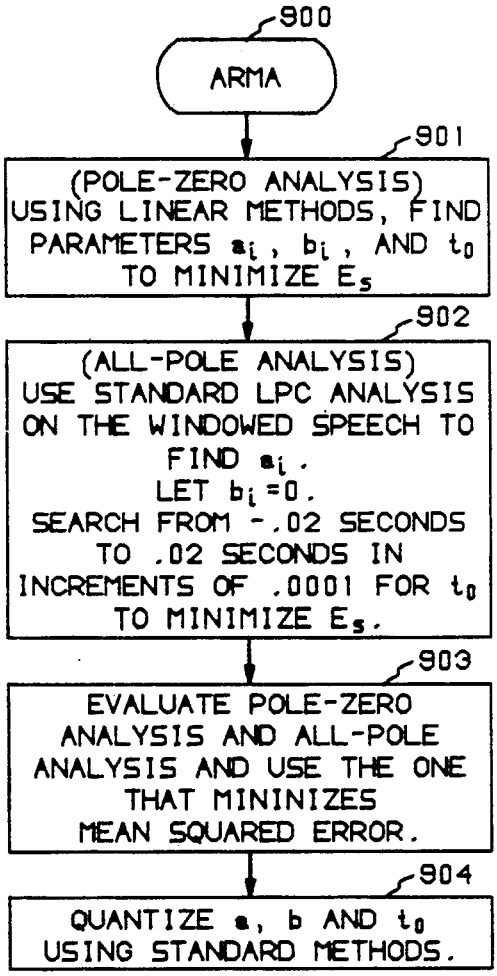
Figure 10:
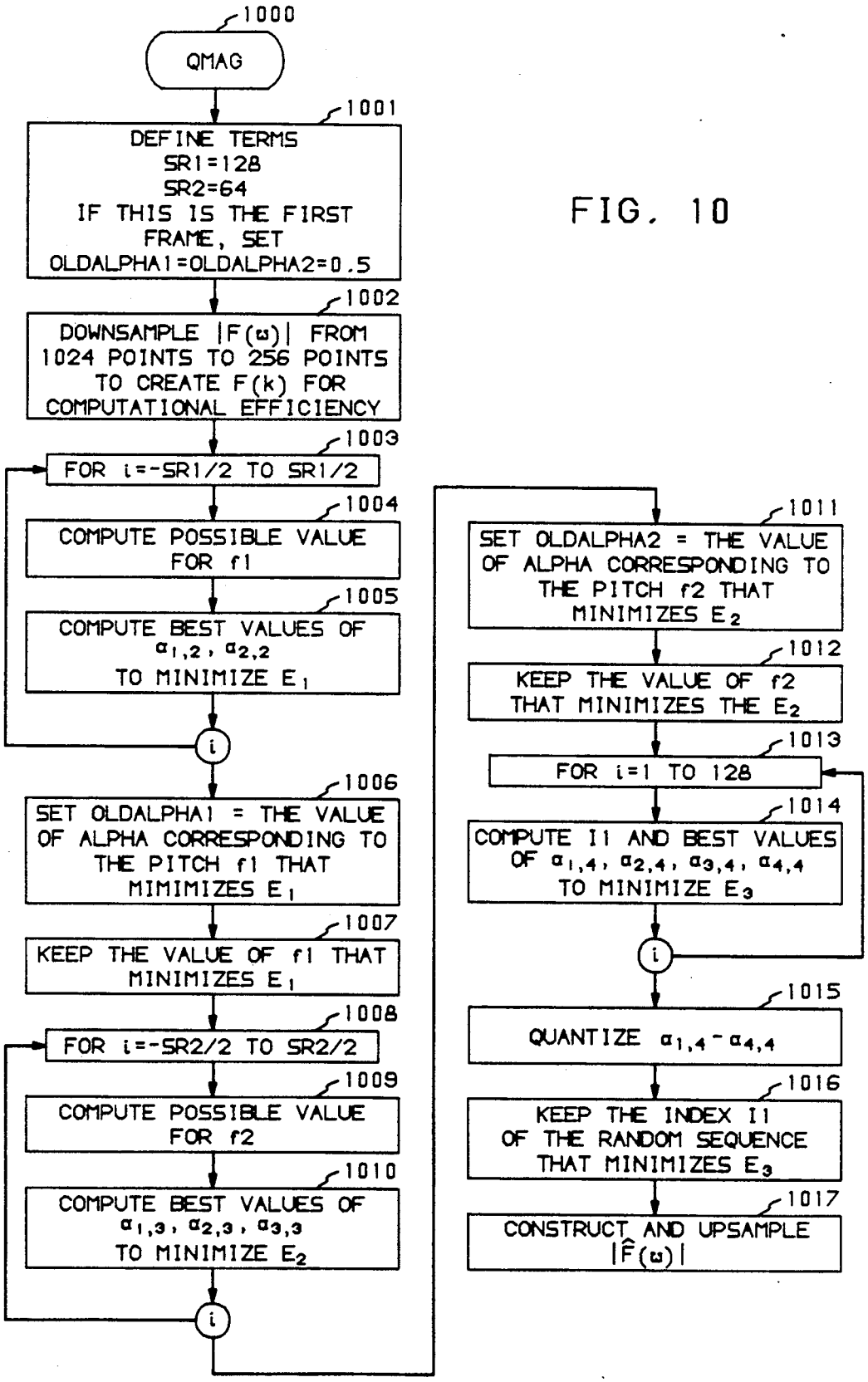
Figure 11:
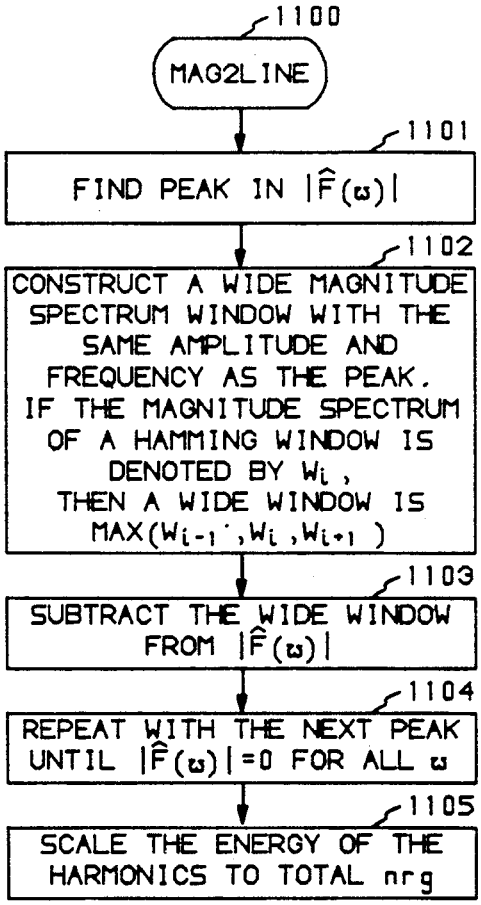
Figure 12:
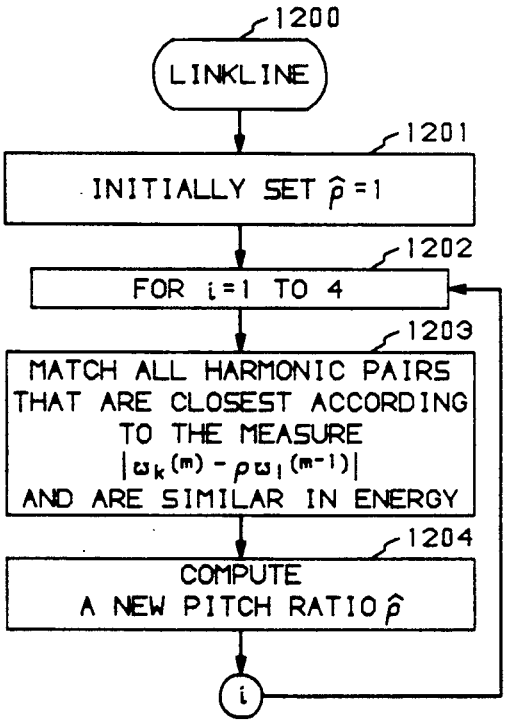
Figure 13:
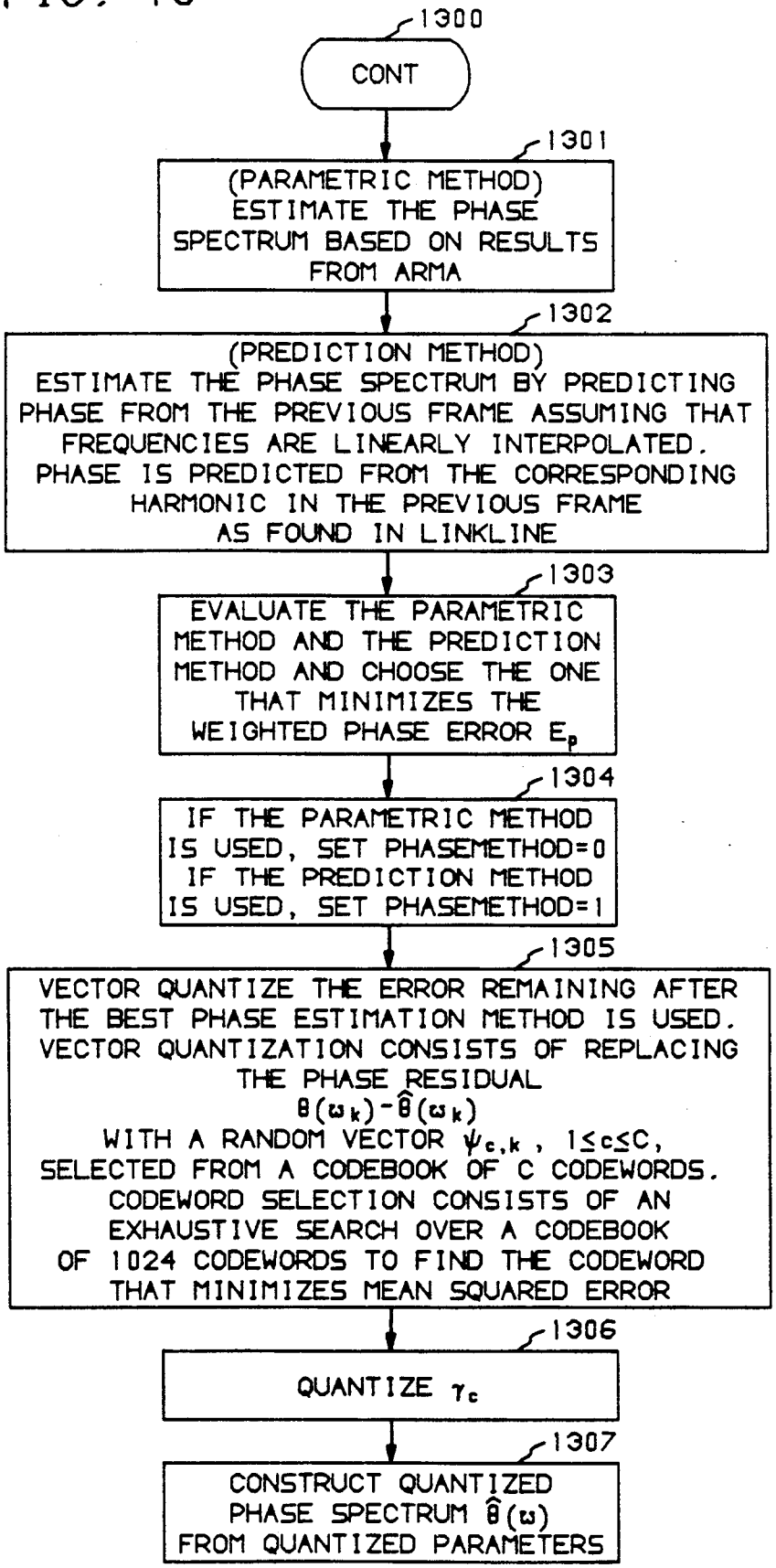

FIG. 6 is a flow chart of an illustrative speech analysis program that performs the functions of speech analyzer 120 (FIG. 1) and channel encoder 130. In accordance with the example, L, the spacing between frame centers is 160 samples. W, the frame length, is 320 samples. F, the number of samples of the FFT, is 1024 samples. The number of poles, P, and the number of zeros, Z, used in the analysis are eight and three, respectively. The analog speech is sampled at a rate of 8000 samples per second. The digital speech samples received at block 600 (FIG. 6) are processed by a TIME2POL routine 601 shown in detail in FIG. 8 as comprising blocks 800 through 804. The window-normalized energy is computed in block 802 using equation (10). Processing proceeds from routine 601 (FIG. 6) to an ARMA routine 602 shown in detail in FIG. 9 as comprising blocks 900 through 904. In block 902, $E_s$ is given by equation (5) where $H(\omega_k)$ is given by equation (4). Equation (11) is used for the all-pole analysis in block 903. Expression (12) is used for the mean squared error in block 904. Processing proceeds from routine 602 (FIG. 6) to a QMAG routine 603 shown in detail in FIG. 10 as comprising blocks 1000 through 1017. In block 1004, equations (13) and (14) are used to compute f1. In block 1005, $E_1$ is given by equation (15). In block 1009, equations (16) and (17) are used to compute f2. In block 1010, $E_2$ is given by equation (18). In block 1014, $E_3$ is given by equation (19). In block 1017, the estimated magnitude spectrum, $|F(\omega)|$, is constructed using equation (20). Processing proceeds from routine 603 (FIG. 6) to a MAG2LINE routine 604 shown in detail in FIG. 11 as comprising blocks 1100 through 1105. Processing proceeds from routine 604 (FIG. 6) to a LINKLINE routine 605 shown in detail in FIG. 12 as comprising blocks 1200 through 1204. Sinusoid matching is performed between the previous and present frames and between the present and subsequent frames. The routine shown in FIG. 12 matches sinusoids between frames m and (m−1). In block 1203, pairs are not similar in energy if the ratio given by expression (7) is less that 0.25 or greater than 4.0. In block 1204, the pitch ratio, p, is given by equation (21). Processing proceeds from routine 605 (FIG. 6) to a CONT routine 606 shown in detail in FIG. 13 as comprising blocks 1300 through 1307. In block 1301, the estimate is made by evaluating expression (22). In block 1303, the weighted phase error, is given by equation (23), where $A_k$ is the amplitude of each sinusoid, $\hat{\theta}(\omega_k)$ is the true phase, and $\hat{\theta}(\omega_k)$ is the estimated phase. In block 1305, mean squared error is given by expression (24). In block 1307, the construction is based on equation (25) if the parameter, phasemethod, is zero, and is based on equation (26) if phasemethod is one. In equation (26), t, the time between frame centers, is given by L/8000. Processing proceeds from routine 606 (FIG. 6) to an ENC routine 607 where the parameters are encoded.

Figure 7:
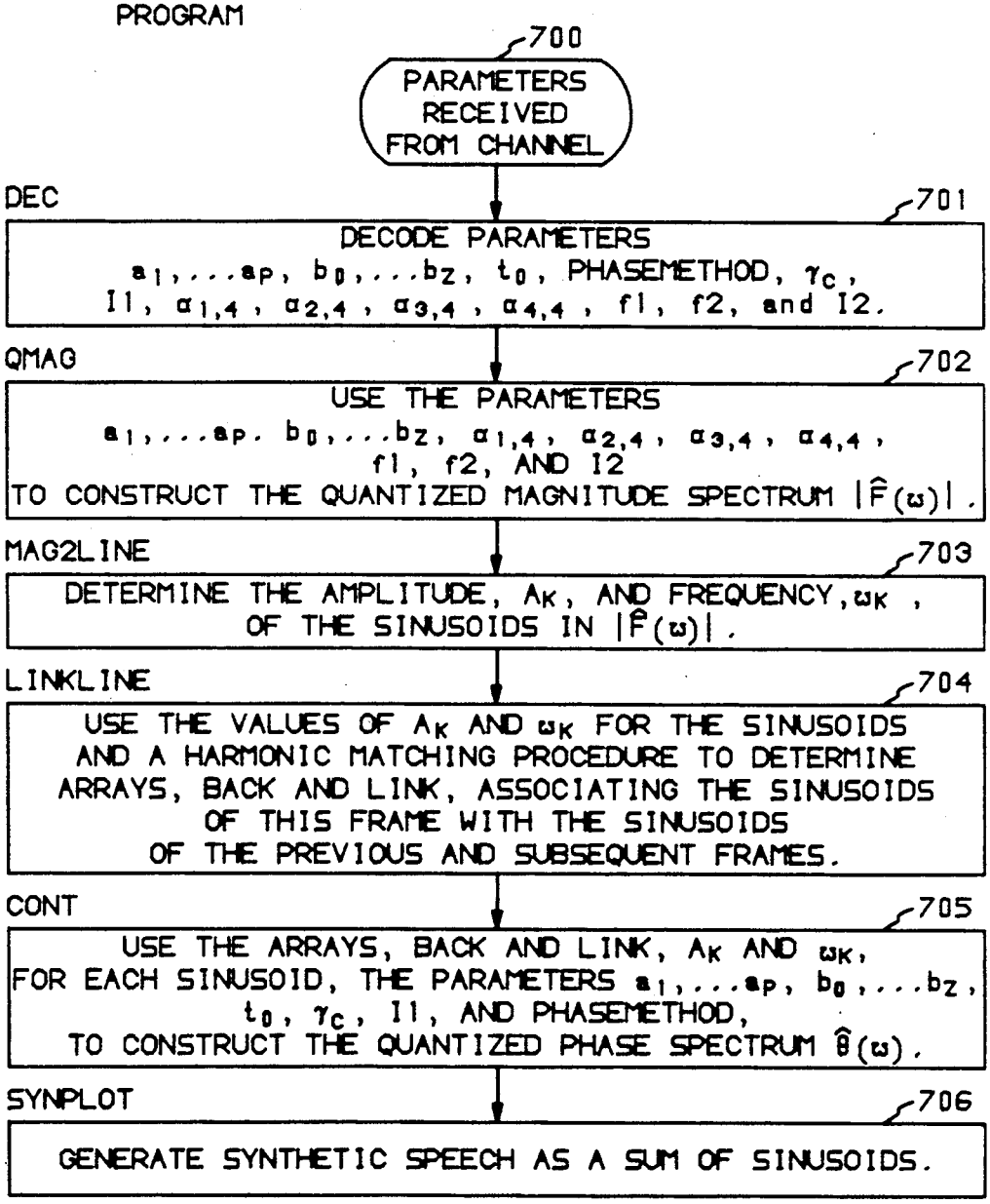
Figure 14:
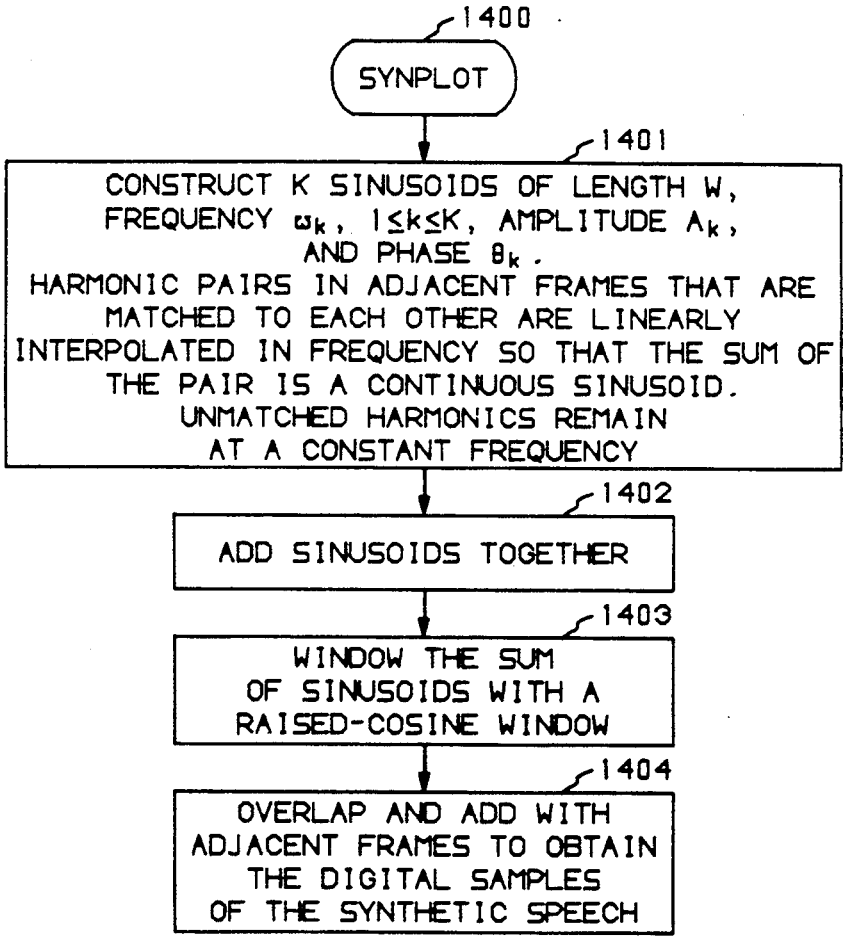
FIG. 14 is a more detailed flow chart of a routine included in the speech synthesis program of FIG. 7.

FIG. 7 is a flow chart of an illustrative speech synthesis program that performs the functions of channel decoder 150 (FIG. 1) and speech synthesizer 160. The parameters received in block 700 (FIG. 7) are decoded in a DEC routine 701. Processing proceeds from routine 701 to a QMAG routine 702 which constructs the quantized magnitude spectrum $|F(\omega)|$ based on equation (1). Processing proceeds from routine 702 to a MAG2LINE routine 703 which is similar to MAG2LINE routine 604 (FIG. 6) except that energy is not rescaled. Processing proceeds from routine 703 (FIG. 7) to a LINKLINE routine 704 which is similar to LINKLINE routine 605 (FIG. 6). Processing proceeds from routine 704 (FIG. 7) to a CONT routine 705 which is similar to CONT routine 606 (FIG. 6), however only one of the phase estimation methods is performed (based on the value of phasemethod) and, for the parametric estimation, only all-pole analysis or pole-zero analysis is performed (based on the values of the received parameters $b_i$). Processing proceeds from routine 705 (FIG. 7) to a SYNPLOT routine 706 shown in detail in FIG. 14 as comprising blocks 1400 through 1404.

The routines shown in FIGS. 8 through 14 are found in the C language source program of the Microfiche Appendix. The C language source program is intended for execution on a Sun Microsystems Sun 3/110 computer system with appropriate peripheral equipment or a similar system.

Figure 15:
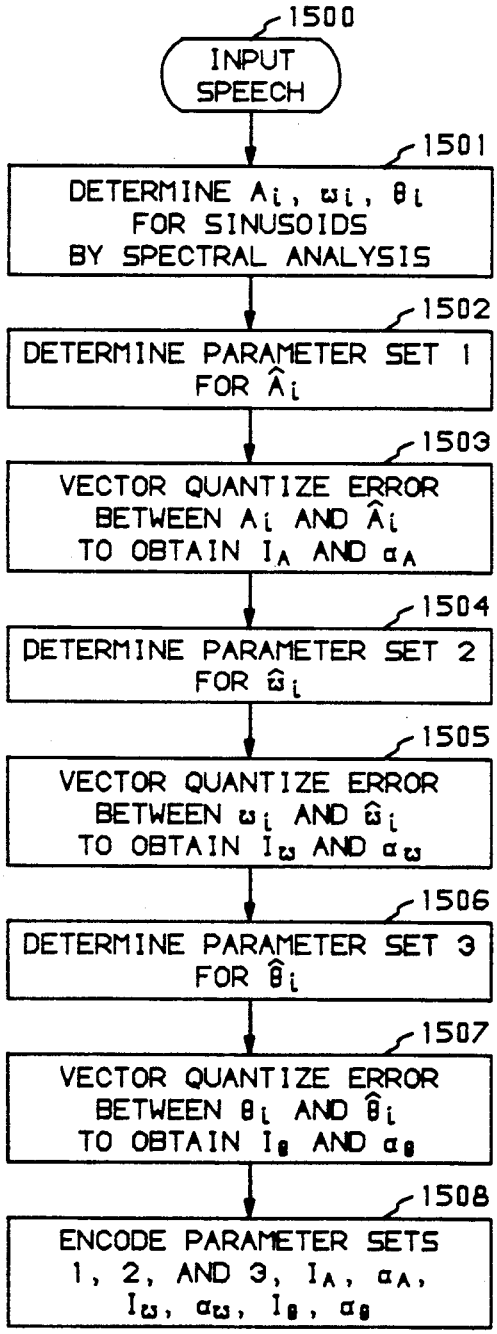
FIGS. 15 and 16 are flow charts of alternative speech analysis and speech synthesis programs, respectively.
Figure 16:
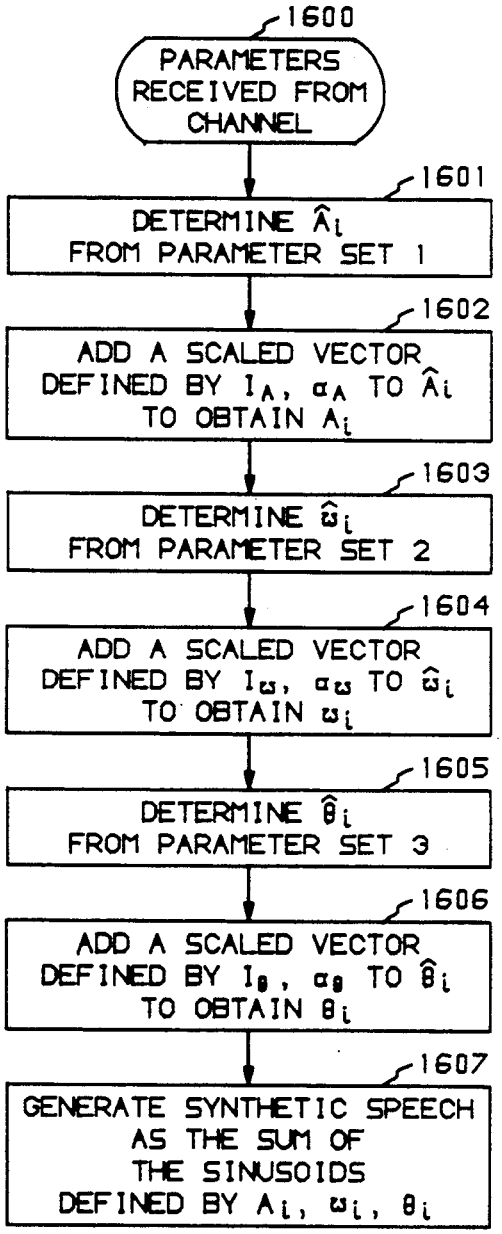

FIGS. 15 and 16 are flow charts of alternative speech analysis and speech synthesis programs, respectively, for harmonic speech coding. In FIG. 15, processing of the input speech begins in block 1501 where a spectral analysis, for example finding peaks in a magnitude spectrum obtained by performing an FFT, is used to determine $A_i$, $\omega_i$, $\theta_i$ for a plurality of sinusoids. In block 1502, a parameter set 1 is determined in obtaining estimates, $\hat{A}_i$, using, for example, a linear predictive coding (LPC) analysis of the input speech. In block 1503, the error between $A_i$ and $\hat{A}_i$ is vector quantized in accordance with an error criterion to obtain an index, $I_A$, defining a vector in a codebook, and a scale factor, $\alpha_A$. In block 1504, a parameter set 2 is determined in obtaining estimates, $\omega_i$, using, for example, a fundamental frequency, obtained by pitch detection of the input speech, and multiples of the fundamental frequency. In block 1505, the error between $\omega_i$ and $\omega_i$ is vector quantized in accordance with an error criterion to obtain an index, $I_\omega$, defining a vector in a codebook, and a scale factor $\alpha_\omega$. In block 1506, a parameter set 3 is determined in obtaining estimates, $\theta_i$, from the input speech using, for example either parametric analysis or phase prediction as described previously herein. In block 1507, the error between $\theta_i$ and $\theta_i$ is vector quantized in accordance with an error criterion to obtain an index, $I_\theta$, defining a vector in a codebook, and a scale factor, $\alpha_\theta$. The various parameter sets, indices, and scale factors are encoded in block 1508. (Note that parameter sets 1, 2, and 3 are typically not disjoint sets.)

FIG. 16 is a flow chart of the alternative speech synthesis program. Processing of the received parameters begins in block 1601 where parameter set 1 is used to obtain the estimates, $\hat{A}_i$. In block 1602, a vector from a codebook is determined from the index, $I_A$, scaled by the scale factor, $\alpha_A$, and added to $\hat{A}_i$ to obtain $A_i$. In block 1603, parameter set 2 is used to obtain the estimates, $\omega_i$. In block 1604, a vector from a codebook is determined from the index $I_\omega$, scaled by the scale factor, $\alpha_\omega$, and added to $\omega_i$ to obtain $\omega_i$. In block 1605, a parameter set 3 is used to obtain the estimates, $\theta_i$. In block 1606, a vector from a codebook is determined from the index, $I_\theta$, and added to $\theta_i$ to obtain $\hat{\theta}_i$. In block 1607, synthetic speech is generated as the sum of the sinusoids defined by $A_i$, $\omega_i$, $\theta_i$.

It is to be understood that the above-described harmonic speech coding arrangements are merely illustrative of the principles of the present invention and that many variations may be devised by those skilled in the art without departing from the spirit and scope of the invention. For example, in the illustrative harmonic speech coding arrangements described herein, parameters are communicated over a channel for synthesis at the other end. The arrangements could also be used for efficient speech storage where the parameters are communicated for storage in memory, and are used to generate synthetic speech at a later time. It is therefore intended that such variations be included within the scope of the claims.

What is claimed is:

1. In a harmonic speech coding arrangement, a method of processing speech signals, said speech signals comprising frames of speech, said method comprising determining from a present one of said frames a magnitude spectrum having a plurality of spectrum points, the frequency of each of said spectrum points being independent of said speech signals, calculating a set of parameters for a continuous magnitude spectrum that models said determined magnitude spectrum at each of said spectrum points, the number of parameters of said set being less than the number of said spectrum points, said continuous magnitude spectrum comprising a sum of a plurality of functions, one of said functions being a magnitude spectrum for a previous one of said frames, encoding said set of parameters as a set of parameter signals representing said speech signals, communicating said set of parameter signals representing said speech signals for use in speech synthesis, and synthesizing speech based on said communicated set of parameter signals.

2. A method in accordance with claim 1 wherein at least one of said functions is a magnitude spectrum of a periodic pulse train.

3. A method in accordance with claim 1 wherein one of said functions is a magnitude spectrum of a first periodic pulse train and another one of said functions is a magnitude spectrum of a second periodic pulse train.

4. A method in accordance with claim 1 wherein one of said functions is a vector chosen from a codebook.

5. A method in accordance with claim 1 further comprising determining a phase spectrum from a present one of said frames, calculating a second set of parameters modeling said determined phase spectrum by prediction of a phase spectrum for said present frame from a phase spectrum for a previous one of said frames, encoding said second set of parameters as a second set of parameter signals representing said speech signals, and communicating said second set of parameter signals representing said speech signals for use in speech synthesis.

6. A method in accordance with claim 1 wherein said determining comprises determining one magnitude spectrum from a present one of said frames, and determining another magnitude spectrum from a previous one of said frames, and wherein said method further comprises determining one plurality of sinusoids from said one magnitude spectrum, determining another plurality of sinusoids from said another magnitude spectrum, matching ones of said one plurality of sinusoids with ones of said another plurality of sinusoids based on sinusoidal frequency, determining a phase spectrum from said present frame, calculating a second set of parameters modeling said determined phase spectrum by prediction of a phase spectrum for said present frame from a phase spectrum for a previous one of said frames based on said matched ones of said one and said another pluralities of sinusoids, encoding said second set of parameters as a second set of parameter signals representing said speech signals, and communicating said second set of parameter signals representing said speech signals for use in speech synthesis.

7. A method in accordance with claim 1 wherein said determining comprises determining one magnitude spectrum from a present one of said frames, and determining another magnitude spectrum from a previous one of said frames, and wherein said method further comprises determining one plurality of sinusoids from said one magnitude spectrum, determining another plurality of sinusoids from said another magnitude spectrum, matching ones of said one plurality of sinusoids with ones of said another plurality of sinusoids based on sinusoidal frequency and amplitude, determining a phase spectrum from said present frame, calculating a second set of parameters modeling said determined phase spectrum by prediction of a phase spectrum for said present frame from a phase spectrum for a previous one of said frames based on said matched ones of said one and said another pluralities of sinusoids, encoding said second set of parameters as a second set of parameter signals representing said speech signals, and communicating said second set of parameter signals representing said speech signals for use in speech synthesis.

8. A method in accordance with claim 1 wherein said determining comprises determining one magnitude spectrum from a present one of said frames, and determining another magnitude spectrum from a previous one of said frames, and wherein said method further comprises determining one plurality of sinusoids from said one magnitude spectrum, determining another plurality of sinusoids from said another magnitude spectrum, determining a pitch of said present frame, determining a pitch of said frame other than said present frame, determining a ratio of said pitch of said present frame and said pitch of said frame other than said present frame, matching ones of said one plurality of sinusoids with ones of said another plurality of sinusoids based on sinusoidal frequency and said determined ratio, determining a phase spectrum from said present frame, calculating a second set of parameters modeling said determined phase spectrum by prediction of a phase spectrum for said present frame from a phase spectrum for a previous one of said frames based on said matched ones of said one and said another pluralities of sinusoids, encoding said second set of parameters as a second set of parameter signals representing said speech signals, and communicating said second set of parameter signals representing said speech signals for use in speech synthesis.

9. A method in accordance with claim 1 wherein said determining comprises determining one magnitude spectrum from a present one of said frames, and determining another magnitude spectrum from a previous one of said frames other than said present frame, and wherein said method further comprises determining one plurality of sinusoids from said one magnitude spectrum, determining another plurality of sinusoids from said another magnitude spectrum, determining a pitch of said present frame, determining a pitch of said frame other than said present frame, determining a ratio of said pitch of said present frame and said pitch of said frame other than said present frame, matching ones of said one plurality of sinusoids with ones of said another plurality of sinusoids based on sinusoidal frequency and amplitude and said determined ratio, determining a phase spectrum from said present frame, calculating a second set of parameters modeling said determined phase spectrum by prediction of a phase spectrum for said present frame from a phase spectrum for a previous one of said frames based on said matched ones of said one and said another pluralities of sinusoids, encoding said second set of parameters as a second set of parameter signals representing said speech signals, and communicating said second set of parameter signals representing said speech signals for use in speech synthesis.

10. A method in accordance with claim 1 said method further comprising determining a phase spectrum from a present one of said frames, obtaining a first phase estimate by parametric analysis of said present frame, obtaining a second phase estimate by prediction of a phase spectrum for said present frame from a phase spectrum for a previous one of said frames, selecting one of said first and second phase estimates, determining a second set of parameters, said second parameter set being associated with said selected phase estimate and said second parameter set modeling said determined phase spectrum, encoding said second set of parameters as a second set of parameter signals representing said speech signals, and communicating said second set of parameter signals representing said speech signals for use in speech synthesis.

11. A method in accordance with claim 1 said method further comprising determining a plurality of sinusoids from said determined magnitude spectrum, determining a phase spectrum from a present one of said frames, obtaining a first phase estimate by parametric analysis of said present frame, obtaining a second phase estimate by prediction of a phase spectrum for said present frame from a phase spectrum for a previous one of said frames, selecting one of said first and second phase estimates in accordance with an error criterion at the frequencies of said determined sinusoids, determining a second set of parameters, said second parameter set being associated with said selected phase estimate and said second parameter set modeling said determined phase spectrum, encoding said second set of parameters as a second set of parameter signals representing said speech signals, and communicating said second set of parameter signals representing said speech signals for use in speech synthesis.

12. In a harmonic speech coding arrangement, a method of processing speech signals comprising determining from said speech signals a magnitude spectrum having a plurality of spectrum points, the frequency of each of said spectrum points being independent of said speech signals, calculating a set of parameters for a continuous magnitude spectrum that models said determined magnitude spectrum at each of said spectrum points, the number of parameters of said set being less than the number of said spectrum points, encoding said set of parameters as a set of parameter signals representing said speech signals, communicating said set of parameter signals representing said speech signals for use in speech synthesis, and synthesizing speech based on said communicated set of parameter signals; wherein said calculating comprises calculating said parameter set to fit said continuous magnitude spectrum to said determined magnitude spectrum in accordance with a minimum mean squared error criterion.

13. In a harmonic speech coding arrangement, a method of processing speech signals comprising determining from said speech signals a magnitude spectrum having a plurality of spectrum points, the frequency of each of said spectrum points being independent of said speech signals, calculating a set of parameters for a continuous magnitude spectrum that models said determined magnitude spectrum at each of said spectrum points, the number of parameters of said set being less than the number of said spectrum points, encoding said set of parameters as a set of parameter signals representing said speech signals, communicating said set of parameter signals representing said speech signals for use in speech synthesis, determining a phase spectrum from said speech signals, calculating a second set of parameters modeling said determined phase spectrum, encoding said second set of parameters as a second set of parameter signals representing said speech signals, communicating said second set of parameter signals representing said speech signals for use in speech synthesis, and synthesizing speech based on said communicated sets of parameter signals.

14. A method in accordance with claim 13 wherein said calculating a second set of parameters comprises calculating said second parameter set modeling said determined phase spectrum as a sum of a plurality of functions.

15. A method in accordance with claim 14 wherein one of said functions is a vector chosen from a codebook.

16. A method in accordance with claim 13 wherein said calculating a second set of parameters comprises calculating said second parameter set using pole-zero analysis to model said determined phase spectrum.

17. A method in accordance with claim 13 wherein said calculating a second set of parameters comprises calculating said second parameter set using all pole analysis to model said determined phase spectrum.

18. A method in accordance with claim 13 wherein said calculating a second set of parameters comprises using pole-zero analysis to model said determined phase spectrum, using all pole analysis to model said determined phase spectrum, selecting one of said pole-zero analysis and said all pole analysis, and determining said second parameter set based on said selected analysis.

19. In a harmonic speech coding arrangement, a method of processing speech signals comprising determining from said speech signals a magnitude spectrum having a plurality of spectrum points, the frequency of each of said spectrum points being independent of said speech signals, calculating a set of parameters for a continuous magnitude spectrum that models said determined magnitude spectrum at each of said spectrum points, the number of parameters of said set being less than the number of said spectrum points, encoding said set of parameters as a set of parameter signals representing said speech signals, communicating said set of parameter signals representing said speech signals for use in speech synthesis, determining a plurality of sinusoids from said determined magnitude spectrum, determining a phase spectrum from said speech signals, calculating a second set of parameters modeling said determined phase spectrum at the frequencies of said determined sinusoids, and encoding said second set of parameters as a second set of parameter signals representing said speech signals, communicating said second set of parameter signals representing said speech signals for use in speech synthesis, and synthesizing speech based on said communicated sets of parameter signals.

20. In a harmonic speech coding arrangement, a method of synthesizing speech comprising receiving a set of parameters corresponding to input speech comprising frames of input speech, determining a spectrum from said parameter set, said spectrum having amplitude values for a range of frequencies, said determining a spectrum comprising determining an estimated magnitude spectrum for a present one of said frames as a sum of a plurality of functions, one of said functions being an estimated magnitude spectrum for a previous one of said frames, said method further comprising determining a plurality of sinusoids from said spectrum, the sinusoidal frequency of at least one of said sinusoids being determined based on amplitude values of said spectrum, and synthesizing speech as a sum of said sinusoids.

21. A method in accordance with claim 20 wherein at least one of said functions is a magnitude spectrum of a periodic pulse train, the frequency of said pulse train being defined by said received parameter set.

22. A method in accordance with claim 20 wherein one of said functions is a magnitude spectrum of a first periodic pulse train and another one of said functions is a magnitude spectrum of a second periodic pulse train, the frequencies of said first and second pulse trains being defined by said received parameter set.

23. A method in accordance with claim 20 wherein said determining a spectrum comprises determining an estimated phase spectrum using an all pole model and said received parameter set.

24. A method in accordance with claim 20 wherein said receiving step comprises receiving said parameter set for said present frame of speech, and wherein said determining a spectrum comprises in response to a first value of one parameter of said parameter set, determining an estimated phase spectrum for said present frame using a parametric model and said parameter set, and in response to a second value of said one parameter, determining an estimated phase spectrum for said present frame using a prediction model based on a previous frame of speech.

25. A method in accordance with claim 20 wherein said receiving comprises receiving one set of parameters for one of said frames of input speech and another set of parameters for another of said frames of input speech after said one frame, wherein said determining a spectrum comprises determining one spectrum from said one parameter set and another spectrum from said another parameter set, wherein said determining a plurality of sinusoids comprises determining one plurality of sinusoids from said one spectrum and another plurality of sinusoids from said another spectrum, wherein said method further comprises matching ones of said one plurality of sinusoids with ones of said another plurality of sinusoids based on sinusoidal frequency, and wherein said synthesizing comprises interpolating between matches ones of said one and said another pluralities of sinusoids.

26. A method in accordance with claim 20 wherein said receiving comprises receiving one set of parameters for one of said frames of input speech and another set of parameters for another of said frames of input speech after said one frame, wherein said determining a spectrum comprises determining one spectrum from said one parameter set and another spectrum from said another parameter set, wherein said determining a plurality of sinusoids comprises determining one plurality of sinusoids from said one spectrum and another plurality of sinusoids from said another spectrum, wherein said method further comprises matching ones of said one plurality of sinusoids with ones of said another plurality of sinusoids based on sinusoidal frequency and amplitude, and wherein said synthesizing comprises interpolating between matched ones of said one and said another pluralities of sinusoids.

27. A method in accordance with claim 20 wherein said receiving comprises receiving one set of parameters for one of said frames of input speech and another set of parameters for another of said frames of input speech after said one frame, wherein said determining a spectrum comprises determining one spectrum from said one parameter set and another spectrum from said another parameter set, wherein said determining a plurality of sinusoids comprises determining one plurality of sinusoids from said one spectrum and another plurality of sinusoids from said another spectrum, wherein said method further comprises determining a pitch of said present frame, determining a pitch of said frame other than said present frame, determining a ratio of said pitch of said one frame and said pitch of said another frame, and matching ones of said one plurality of sinusoids with ones of said another plurality of sinusoids based on sinusoidal frequency and said determined ratio, and wherein said synthesizing comprises interpolating between matched ones of said one and said another pluralities of sinusoids.

28. A method in accordance with claim 20 wherein said receiving comprises receiving one set of parameters for one of said frames of input speech and another set of parameters for another of said frames of input speech after said one frame, wherein said determining a spectrum comprises determining one spectrum from said one parameter set and another spectrum from said another parameter set, wherein said determining a plurality of sinusoids comprises determining one plurality of sinusoids from said one spectrum and another plurality of sinusoids from said another spectrum, wherein said method further comprises determining a pitch of said present frame, determining a pitch of said frame other than said present frame, determining a ratio of said pitch of said one frame and said pitch of said another frame, and matching ones of said one plurality of sinusoids with ones of said another plurality of sinusoids based on sinusoidal frequency and amplitude and said determined ratio, and wherein said synthesizing comprises interpolating between matched ones of said one and said another pluralities of sinusoids.

29. In a harmonic speech coding arrangement, a method of synthesizing speech comprising receiving a set of parameters, determining a spectrum having amplitude values for a range of frequencies from said parameter set by estimating a magnitude spectrum as a sum of a plurality of functions, wherein one of said functions is a vector from a codebook, said vector being identified by an index defined by said received parameter set, determining a plurality of sinusoids from said spectrum, the sinusoidal frequency of at least one of said sinusoids being determined based on amplitude values of said spectrum, and synthesizing speech as a sum of said sinusoids.

30. In a harmonic speech coding arrangement, a method of synthesizing speech comprising receiving a set of parameters, determining a spectrum from said parameter set, said spectrum having amplitude values for a range of frequencies, determining a plurality of sinusoids from said spectrum, the sinusoidal frequency of at least one of said sinusoids being determined based on amplitude values of said spectrum, and synthesizing speech as a sum of said sinusoids;

wherein said determining a spectrum comprises determining an estimated phase spectrum as a sum of a plurality of functions.

31. A method in accordance with claim 30 wherein one of said functions is a vector from a codebook, said vector being identified by an index defined by said received parameter set.

32. In a harmonic speech coding arrangement, a method of synthesizing speech comprising receiving a set of parameters, determining a spectrum from said parameter set, said spectrum having amplitude values for a range of frequencies, determining a plurality of sinusoids from said spectrum, the sinusoidal frequency of at least one of said sinusoids being determined based on amplitude values of said spectrum, and synthesizing speech as a sum of said sinusoids;

wherein said determining a spectrum comprises determining an estimated phase spectrum using a pole-zero model and said received parameter set.

33. In a harmonic speech coding arrangement, a method of synthesizing speech comprising receiving a set of parameters, determining a spectrum from said parameter set, said spectrum having amplitude values for a range of frequencies, determining a plurality of sinusoids from said spectrum, the sinusoidal frequency of at least one of said sinusoids being determined based on amplitude values of said spectrum, and synthesizing speech as a sum of said sinusiods;

wherein said determining a spectrum comprises determining an estimated magnitude spectrum, wherein said determining a plurality of sinusoids comprises finding a peak in said estimated magnitude spectrum, subtracting from said estimated magnitude spectrum a spectral component for a sinusoid with the frequency and amplitude of said peak, and repeating said finding and said subtracting until the estimated magnitude spectrum is below a threshold for all frequencies.

34. A method in accordance with claim 33 wherein said spectral component comprises a wide magnitude spectrum window.

35. In a harmonic speech coding arrangement, a method of synthesizing speech comprising receiving a set of parameters, determining a spectrum from said parameter set, said spectrum having amplitude values for a range of frequencies, determining a plurality of sinusoids from said spectrum, the sinusoidal frequency of at least one of said sinusoids being determined based on amplitude values of said spectrum, and synthesizing speech as a sum of said sinusoids;

wherein said determining a spectrum comprises determining an estimated magnitude spectrum, and determining an estimated phase spectrum, wherein said determining a plurality of sinusoids comprises determining sinusoidal amplitude and frequency for each of said sinusoids based on said estimated magnitude spectrum, and determining sinusoidal phase for each of said sinusoids based on said estimated phase spectrum.

36. In a harmonic speech coding arrangement, a method of processing speech, said speech comprising frames of speech, said method comprising determining from said speech a magnitude spectrum having a plurality of spectrum points, the frequency of each of said spectrum points being independent of said speech, said magnitude of spectrum having a plurality of points being determined from a present one of said frames, calculating a set of parameters for a continuous magnitude spectrum that models said determined magnitude spectrum at each of said spectrum points, the number of parameters of said set being less than the number of said spectrum points, said continuous magnitude spectrum comprising a sum of a plurality of functions, one of said functions being a magnitude spectrum for a previous one of said frames, communicating said parameter set, receiving said communicated parameter set, determining a spectrum from said received parameter set, determining a plurality of sinusoids from said spectrum determined from said received parameter set, and synthesizing speech as a sum of said sinusoids.

37. In a harmonic speech coding arrangement, apparatus comprising means responsive to speech signals for determining a magnitude spectrum having a plurality of spectrum points, said speech signals comprising frames of speech, said determining means determining said magnitude spectrum having a plurality of spectrum points from a present one of said frames, means responsive to said determining means for calculating a set of parameters for a continuous magnitude spectrum that models said determined magnitude spectrum at each of said spectrum points, the number of parameters of said set being less than the number of said spectrum points, said continuous magnitude spectrum comprising a sum of a plurality of functions, one of said functions being a magnitude spectrum for a previous one of said frames, means for encoding said set of parameters as a set of parameter signals representing said speech signals, means for communicating said set of parameter signals representing said speech signals for use in speech synthesis, and means for synthesizing speech based on said set of parameter signals communicated by said communicating means.

38. In a harmonic speech coding arrangement, a speech synthesizer comprising means responsive to receipt of a set of parameters corresponding to input speech comprising frames of input speech for determining a spectrum, said spectrum having amplitude values for a range of frequencies, said determining means including means for developing an estimated magnitude spectrum for a present one of said frames as a sum of a plurality of functions, one of said functions being an estimated magnitude spectrum for a previous one of said frames, means for determining a plurality of sinusoids from said spectrum, the sinusoidal frequency of at least one said sinusoids being determined based on amplitude values of said spectrum, and means for synthesizing speech as a sum of said sinusoids.

* * * * *

UNITED STATES PATENT AND TRADEMARK OFFICE

CERTIFICATE OF CORRECTION

PATENT NO. : 5,179,626

DATED : January 12, 1993

INVENTOR(S) : D. L. Thomson

It is certified that error appears in the above-indentified patent and that said Letters Patent is hereby corrected as shown below:

Column 5, line 54, equation should be: $$H(\omega_k) = \frac{\sum_{i=0}^{q} b_i e^{-j\omega_k i}}{\sum_{i=0}^{p} a_i e^{-j\omega_k i}}$$

Column 5, line 66, equation should be: $$E_s = \sum_{k=1}^{K} | e^{-j\omega_k t_0} H(\omega_k) - F(\omega_k) |^2$$

Column 8, line 18, equation should be: $$H(\omega_k) = \frac{1}{\sum_{i=0}^{p} a_i e^{-j\omega_k i}}$$

Column 8, line 53, equation should be: $$\hat{\rho} = \sum_{k=1}^{K} \frac{[A_k^{(m)}]^2}{\sum_{i=1}^{K} [A_i^{(m)}]^2} \cdot \frac{\omega_k^{(m)}}{\omega_k^{(m-1)}}$$

UNITED STATES PATENT AND TRADEMARK OFFICE

CERTIFICATE OF CORRECTION

PATENT NO. : 5,179,626

DATED : January 12, 1993

INVENTOR(S) : D. L. Thomson

It is certified that error appears in the above-indentified patent and that said Letters Patent is hereby corrected as shown below:

Column 9, line 2, equation should be: $\theta_m(\omega_k) = \frac{\omega_k^{(m)} + \omega_l^{(m-1)}}{2} t + \gamma_c \Psi_{c,k}$ Column 19, line 52, "matches" should be --matched--.

Signed and Sealed this

Seventh Day of December, 1993

Bruce Lehman

*Attest:*

BRUCE LEHMAN

*Attesting Officer*

*Commissioner of Patents and Trademarks*